US009784148B2

(12) United States Patent
Fujita

(10) Patent No.: US 9,784,148 B2
(45) Date of Patent: Oct. 10, 2017

(54) VALVE GEAR FOR ENGINE

(71) Applicant: YAMAHA HATSUDOKI KABUSHIKI KAISHA, Iwata-shi, Shizuoka (JP)

(72) Inventor: Hideo Fujita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/101,457

(22) PCT Filed: Dec. 1, 2014

(86) PCT No.: PCT/JP2014/081695

§ 371 (c)(1),
(2) Date: Jun. 3, 2016

(87) PCT Pub. No.: WO2015/083654

PCT Pub. Date: Jun. 11, 2015

(65) Prior Publication Data

US 2016/0369667 A1 Dec. 22, 2016

(30) Foreign Application Priority Data

Dec. 6, 2013 (JP) ..... 2013-252909

(51) Int. Cl.
*F01L 1/34* (2006.01)
*F01L 13/00* (2006.01)
(Continued)

(52) U.S. Cl.
CPC ..... *F01L 13/0005* (2013.01); *F01L 1/053* (2013.01); *F01L 1/181* (2013.01); *F01L 1/185* (2013.01);
(Continued)

(58) Field of Classification Search
CPC ..... F01L 13/0005; F01L 1/053; F01L 1/181; F01L 1/185; F01L 9/021; F01L 2001/0476; F01L 2001/0537; F01L 2105/00
See application file for complete search history.

(56) References Cited

U.S. PATENT DOCUMENTS

2005/0061274 A1* 3/2005 Nakahira ..... F01L 1/022 123/90.16
2009/0151676 A1 6/2009 Kim et al.

FOREIGN PATENT DOCUMENTS

JP 60-090905 A 5/1985
JP 10-18826 A 1/1998
(Continued)

*Primary Examiner* — Zelalem Eshete
(74) *Attorney, Agent, or Firm* — Keating and Bennett, LLP

(57) ABSTRACT

A valve gear for an engine includes cam shafts, first and second support walls, and rocker arms supported on the first and second support walls by supports. The supports switch among a plurality of support modes. The supports include first and second shaft holes, rocker shafts, tracks in the support walls, and return springs. The rocker shafts, move to positions where the support walls and the rocker arms are connected via the rocker shafts in a first support mode. In a second support mode, the rocker shafts move to positions where the connection between the support walls and the rocker arms is canceled. This makes it possible to provide a valve gear for an engine capable of smoothly switching a normal operation state support mode and cylinder resting state support mode, thus increasing the reliability of the operation.

10 Claims, 19 Drawing Sheets

(51) Int. Cl.

| | |
|---|---|
| ***F01L 1/18*** | (2006.01) |
| ***F01L 9/02*** | (2006.01) |
| *F01L 1/047* | (2006.01) |
| *F01L 1/053* | (2006.01) |

(52) U.S. Cl.
CPC ..... *F01L 9/021* (2013.01); *F01L 2001/0476* (2013.01); *F01L 2001/0537* (2013.01); *F01L 2105/00* (2013.01); *F01L 2820/033* (2013.01)

(56) References Cited

FOREIGN PATENT DOCUMENTS

| | | | |
|---|---|---|---|
| JP | 2001-271620 | A | 10/2001 |
| JP | 2008-151115 | A | 7/2008 |
| JP | 2008-190392 | A | 8/2008 |
| JP | 2011-236883 | A | 11/2011 |
| WO | 99/47794 | A1 | 9/1999 |

* cited by examiner

VALVE GEAR FOR ENGINE

BACKGROUND OF THE INVENTION

1. Field of the Invention

The present invention relates to a valve gear for an engine that switches between a mode in which an intake valve or exhaust valve normally operates, and a mode in which the operation of the intake valve or exhaust valve stops.

2. Description of the Related Art

Conventionally, a technique for resting some cylinders while an engine is operating has been known as a technique to further improve fuel consumption. Resting some cylinders is often performed by assembling a switch into a valve gear that drives an intake valve or an exhaust valve.

A conventional switch of this kind is described in, e.g., Japanese Patent Laid-Open No. 2008-151115.

The switch described in Japanese Patent Laid-Open No. 2008-151115 has a structure which switches the support modes of a rocker arm that drives an intake valve or an exhaust valve. The support mode of the rocker arm is switched to a normal operation state support mode or a cylinder resting state support mode.

In the normal operation state, the switch converts the rotation of a cam shaft into a reciprocal motion by using the rocker arm, and transmits the reciprocal motion to the intake valve or the exhaust valve. On the other hand, in the cylinder resting state, the position of the swinging center of the rocker arm changes, i.e., the rocker arm swings around one end that is in contact with the intake valve or exhaust valve, against the spring force of a return spring which biases the other end of the rocker arm. That is, only the rocker arm swings with the intake valve or exhaust valve being closed.

The position of the swinging center of the rocker arm is changed by using a plurality of rocker shafts. The switch includes a first rocker shaft that functions as the rocker arm swinging center in the cylinder resting state, and a second rocker shaft that functions as the rocker arm swinging center in the normal operation state. The first and second rocker shafts are connected with each other by a connecting rod, and are integrated into one rocker shaft assembly. The rocker shaft assembly is able to move in the axial direction between the rocker arm and rocker arm support members provided on the two sides of the rocker arm. Also, the rocker shaft assembly is moved to one side or the other side in the axial direction during switching by being driven by an actuator.

The first and second rocker shafts are parallel and spaced apart from each other in a direction perpendicular to the axial direction, and divided into one side and the other side of the connecting rod in the axial direction. The first and second rocker shafts are provided in shaft holes of the rocker arm support members so as to be pivotal and movable in the axial direction. The connecting rod is accommodated in a groove in the rocker arm support member.

In the normal operation state, the rocker arm assembly moves toward the rocker arm support member. In this state, the first rocker shaft is detached from the rocker arm and accommodated together with the connecting rod in the rocker arm support member. The second rocker shaft pivotally fits into both the rocker arm support member and the rocker arm. In the normal operation state, therefore, the rocker arm swings around the second rocker shaft.

In the cylinder resting state, the second rocker shaft and the connecting rod extend out from the rocker arm support member, and the first rocker shaft pivotally fits into both the rocker arm support member and the rocker arm. In the cylinder resting state, therefore, the rocker arm swings around one end of the first rocker shaft that is in contact with the intake valve or exhaust valve.

The valve gear for an engine described in Japanese Patent Laid-Open No. 2008-151115 has a problem that the reliability of the operation of switching the rocker arm support modes is low. This problem occurs due to the following two reasons.

The first reason is that the structure of the rocker shaft that supports the rocker arm to be swingable is complicated. When the normal operation state support mode shifts to the cylinder resting state support mode, the second rocker shaft and the connecting rod must be detached from the rocker arm support member. On the other hand, when the cylinder resting state support mode shifts to the normal operation state support mode, the second rocker shaft and the connecting rod must be accommodated in the rocker arm support member. That is, a plurality of members must enter and leave the rocker arm support member when switching the support modes. Since switching easily fails, the reliability of the operation decreases.

The second reason is that the connecting rod is relatively thin. That is, the connecting rod may collide against the rocker arm support member and break when the support modes are switched. This decreases the reliability of the operation.

To reliably switch the rocker arm support modes, it may be possible to omit the first rocker shaft and the connecting rod of the above-described rocker shaft assembly and use only the second rocker shaft. In this case, the second rocker shaft is pulled out from the rocker arm and accommodated in the rocker arm support member in the cylinder resting state.

If this arrangement is used, however, the swinging center of the rocker arm moves from a correct position in the cylinder resting state so the second rocker shaft cannot fit into the shaft hole of the rocker arm support member when the cylinder resting state support mode shifts to the normal operation state support mode.

SUMMARY OF THE INVENTION

Preferred embodiments of the present invention provide a valve gear for an engine which smoothly changes between a normal operation state support mode and a cylinder resting state support mode, thus increasing the reliability of operation of the valve gear.

According to a preferred embodiment of the present invention, a valve gear for an engine includes a cam shaft including one of an intake valve driving cam and an exhaust valve driving cam and that is rotatably supported by a cylinder head, a pair of support walls in the cylinder head such that the pair of support walls are spaced apart and face each other in an axial direction of the cam shaft, and a rocker arm including a first end in contact with a valve stem of one of an intake valve and an exhaust valve and a second end inserted between the pair of support walls and supported on the support wall by a support, wherein the support switches a plurality of support modes and includes shaft holes in the pair of support walls and the second end of the rocker arm, the shaft holes extending parallel or substantially parallel to the cam shaft, a rocker shaft that movably fits into the shaft holes, tracks in the pair of support walls, the tracks each extending from the corresponding shaft hole in a direction opposite to the cam shaft, and a return spring that biases the rocker arm toward the cam, the plurality of support modes include a first support mode in which the rocker arm swings around the rocker shaft as a swinging center to convert a rotation of the cam into a reciprocal motion and transmit the reciprocal motion to one of the intake valve and the exhaust valve, and a second support mode in which the rocker arm swings along the track around a portion in contact with the valve stem of one of the intake valve and the exhaust valve, as a swinging center, to keep the one of the intake valve and the exhaust valve closed, and in the first support mode, the rocker shaft moves to a position where the support wall and the rocker arm are connected via the rocker shaft, and, in the second support mode, the rocker shaft moves to a position where a connection between the support walls and the rocker arm is canceled.

In a preferred embodiment of the present invention, the first support mode is used in the normal operation state, and the second support mode is used in the cylinder resting state. This support mode switching is performed by moving the rocker shaft in the axial direction. Since the valve gear for an engine according to preferred embodiments of the present invention uses a simple support structure, the reliability of switching the rocker arm support modes is higher than that of the conventional valve gear described in Japanese Patent Laid-Open No. 2008-151115.

The track determines the rocker arm moving path when the second support mode is used. That is, when the rocker arm swings to one end of the track, the shaft hole of the rocker arm and that of the support wall are positioned on the same axis. Consequently, the second support mode correctly shifts to the first support mode.

Accordingly, preferred embodiments of the present invention provide a valve gear for an engine which smoothly switches between the first support mode in the normal operation state and the second support mode in the cylinder resting state, thus increasing reliability of the operation of the valve gear.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

A first preferred embodiment of a valve gear for an engine will be explained in detail below with reference to FIGS. 1 to 15. In this preferred embodiment, the valve gear is for a cylinder which is resting.

Figure 1:
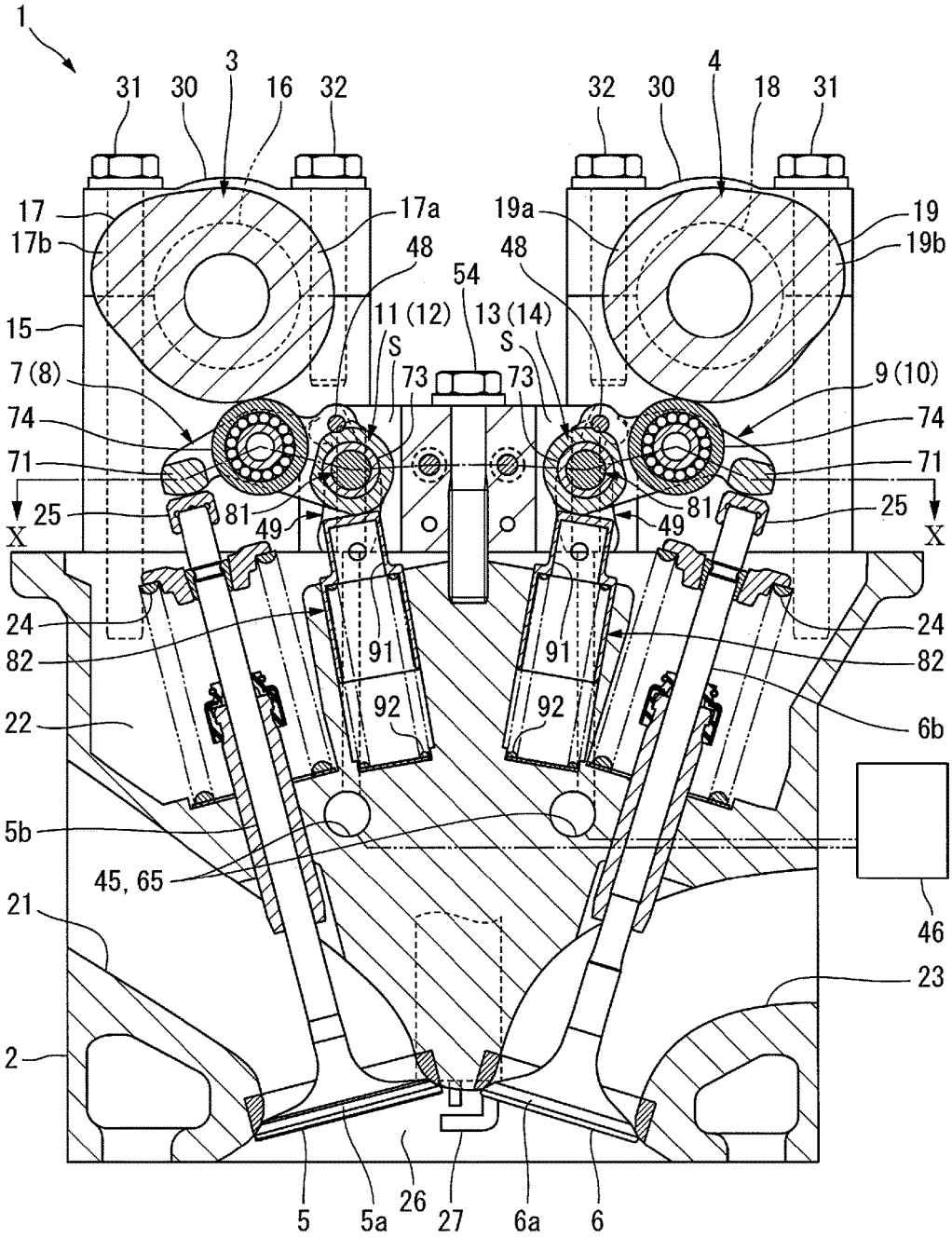
FIG. 1 is a sectional view of a valve gear according to a first preferred embodiment of the present invention.

In a valve gear 1 for an engine shown in FIG. 1, the rotations of an intake cam shaft 3 and an exhaust cam shaft 4 in a cylinder head 2 are changed into reciprocal motions by rocker arms 7 to 10 (see FIG. 2) of intake valves 5 and exhaust valves 6 to drive the intake valves 5 and the exhaust valves 6. The rocker arms 7 to 10 are respectively supported by supports 11 to 14 (to be described below). As will be described in detail below, the supports 11 to 14 are able to be switched between a first support mode in a normal operation state and a second support mode in a cylinder resting state.

The intake cam shaft 3 and the exhaust cam shaft 4 rotate when the rotation of a crank shaft (not shown) is transmitted via a transmission. The intake cam shaft 3 includes an intake cam shaft main body 16 rotatably supported by a journal member 15 of the cylinder head 2, and an intake valve driving cam 17 in the intake cam shaft main body 16. The exhaust cam shaft 4 includes an exhaust cam shaft main body 18 rotatably supported by the journal member 15 described above, and an exhaust valve driving cam 19 in the exhaust cam shaft main body 18.

The intake valve driving cam 17 is provided for each intake valve 5, and the exhaust valve driving cam 19 is provided for each exhaust valve 6. The cams 17 and 19 respectively include base circular portions 17*a* and 19*a* and apexes 17*b* and 19*b*.

Two intake valves 5 and two exhaust valves 6 are provided for one cylinder, for example. The two intake valves 5 are arranged with a predetermined spacing in the axial direction of the intake cam shaft 3. The two exhaust valves 6 are arranged with a predetermined spacing in the axial direction of the exhaust cam shaft 4.

The intake valve 5 includes a valve body 5*a* that opens/closes an intake port 21 of the cylinder head 2, and a valve stem 5*b* extending from the valve body 5*a* into a valve gear chamber 22 of the cylinder head 2. The exhaust valve 6 includes a valve body 6*a* that opens/closes an exhaust port 23 of the cylinder head 2, and a valve stem 6*b* extending from the valve body 6*a* into the valve gear chamber 22 of the cylinder head 2. Valve springs 24 that bias the intake valve 5 and exhaust valve 6 in a closing direction are provided between the distal ends of the valve stems 5*b* and 6*b* and the cylinder head 2. Also, cap-shaped shims 25 are provided on the distal ends of the valve stems 5*b* and 6*b*.

The upstream end of the intake port 21 opens to one side of the cylinder head 2, and the downstream end thereof opens in a combustion chamber 26. The upstream end of the exhaust port 23 opens to the combustion chamber 26, and the downstream end thereof opens to the other side of the cylinder head 2. A spark plug 27 is provided in a central portion of the combustion chamber 26.

The journal member 15 has a function of supporting the intake cam shaft main body 16 and the exhaust cam shaft main body 18 described above, and a function of supporting the rocker arms 7 to 10 to be described below.

Figure 2:
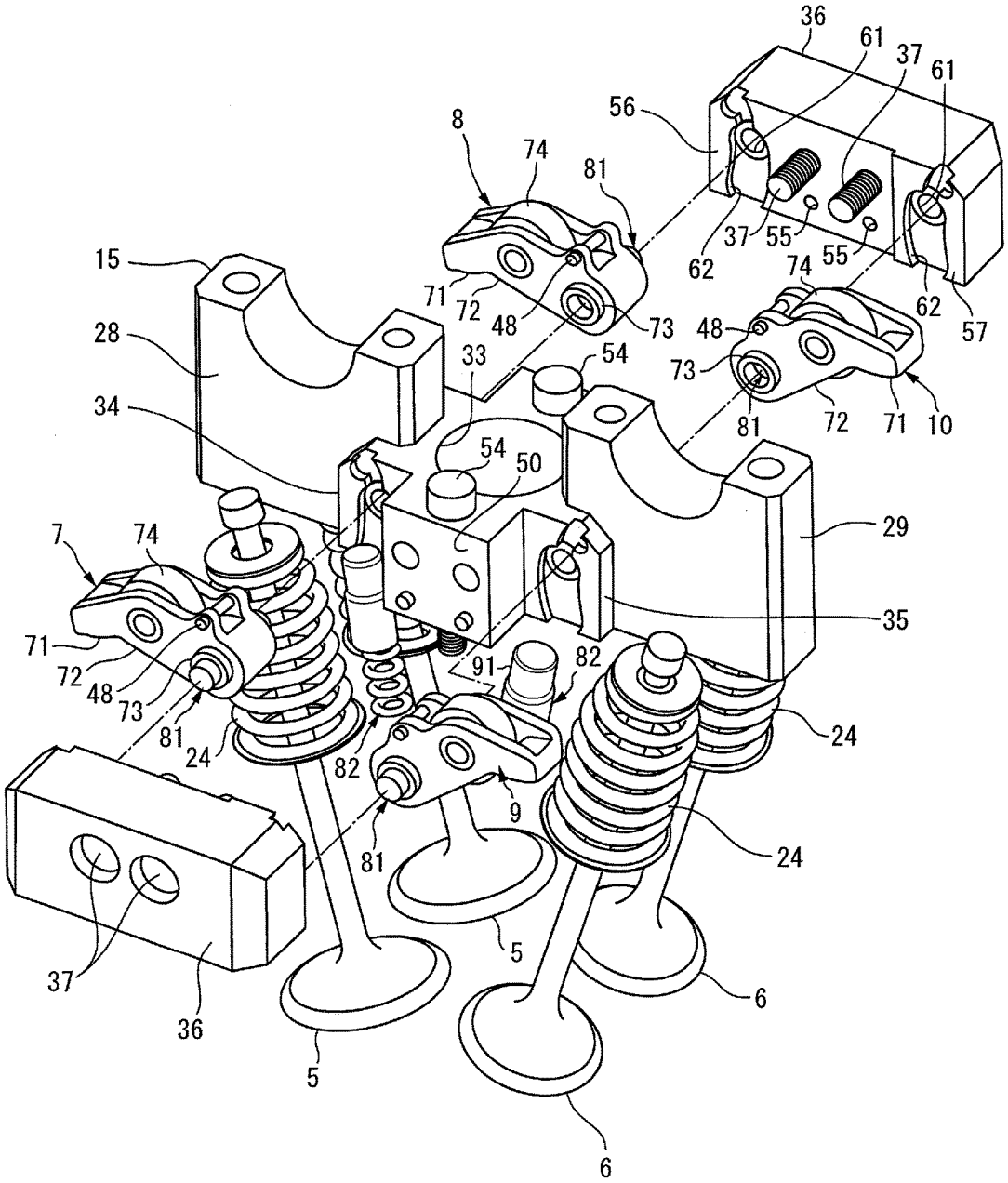
FIG. 2 is an exploded perspective view of the valve gear according to the first preferred embodiment of the present invention.
Figure 3:
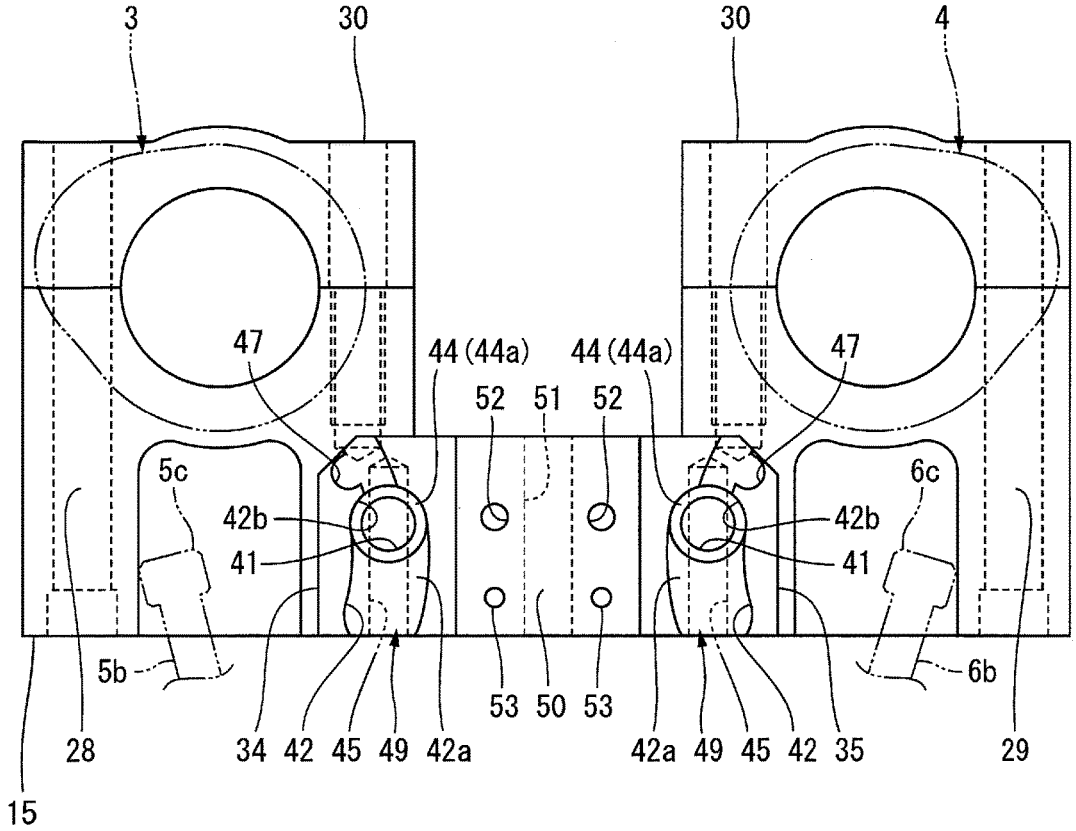
FIG. 3 is a side view of a journal member and cam caps according to the first preferred embodiment of the present invention.

As shown in FIG. 3, the function of supporting the intake cam shaft main body 16 and the exhaust cam shaft main body 18 is implemented by an intake cam shaft journal 28 and an exhaust cam shaft journal 29 provided on the two ends of the journal member 15, and cam caps 30 mounted on the journals 28 and 29. As shown in FIG. 2, the intake cam shaft journal 28 is positioned between the two intake valves 5 for one cylinder. The exhaust cam shaft journal 29 is positioned between the two exhaust valves 6 for one cylinder.

With the cam shaft main bodies 16 and 18 being sandwiched between the journal member 15 and cam caps 30, the cam caps 30 are fixed to the journals 28 and 29 by first fixing bolts 31 and second fixing bolts 32, for example (see FIG. 1). The first fixing bolts 31 positioned on the two ends of the journal member 15 are screwed into the cylinder head 2 through the journal member 15.

As shown in FIG. 2, a hole 33 is provided between the pair of journals 28 and 29 of the journal member 15. The hole 33 is used to attach a spark plug insertion pipe (not shown).

As shown in FIG. 3, the function of supporting the rocker arms 7 to 10 is implemented by using, e.g., first support walls 34 on the intake valve side and first support walls 35 on the exhaust valve side in the central portion of the journal member 15, and support members 36 (see FIGS. 2, 4, and 5) facing the first support walls 34 and 35. The rocker arms 7 to 10 are supported by the supports 11 to 14 (to be described below) so as to be partially inserted between the first support walls 34 on the intake valve side and the first support walls 35 on the exhaust valve side, and the support members 36. In this preferred embodiment, the first support walls 34 and 35 in the journal member 15 correspond to "a first support wall."

The first support walls 34 on the intake valve side and the first support walls 35 on the exhaust valve side are integrated with the journal member 15. Also, the first support walls 34 and 35 are provided on the two sides of the journal member 15. The two sides are sides in the axial direction of the intake cam shaft 3 or the exhaust cam shaft 4. Accordingly, the support members 36 are provided on the two sides of the journal member 15. The support members 36 are separated from the journal member 15 and mounted on the journal member 15 by mounting bolts 37, for example.

As shown in FIG. 3, first shaft holes 41 and first grooves 42 defining portions of the supports 11 to 14 that support the rocker arms 7 to 10 are provided in side surfaces of the first support walls 34 on the intake valve side and the first support walls 35 on the exhaust valve side which face the rocker arms 7 to 10.

Figure 6:
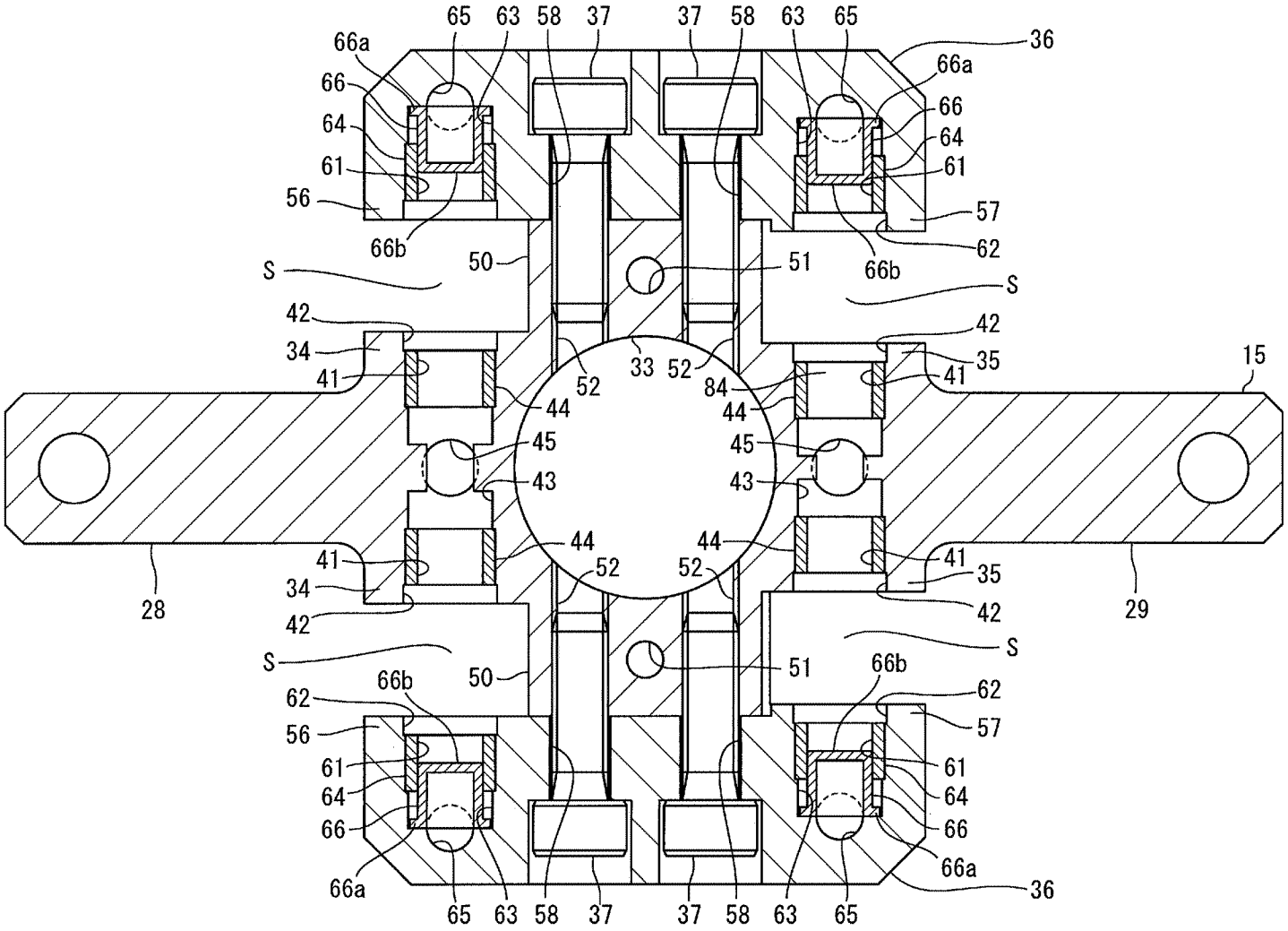
FIG. 6 is a sectional view of the journal member and support members according to the first preferred embodiment of the present invention.

The first shaft holes 41 are positioned between valve stem distal ends 5*c* and 6*c* of the intake valve 5 and the exhaust valve 6 and the cam shafts 3 and 4 in the cylinder axial direction (the vertical direction in FIG. 3). As shown in FIG. 6, the first shaft holes 41 extend through the journal member 15 in the axial direction (the vertical direction in FIG. 6) of the cam shafts 3 and 4. Also, the first shaft holes 41 open in the bottom portions of the first grooves 42 (to be described below).

The first shaft holes 41 according to this preferred embodiment include through holes 43 in the first support walls 34 and 35, and hollow portions of first cylindrical bodies 44 in the openings at the two ends of each through hole 43. The through holes 43 are connected to first hydraulic oil passages 45 (see FIG. 1) in the journal 15 and the cylinder head 2. The first hydraulic oil passages 45 are connected to a hydraulic actuator 46 that applies an oil pressure to the first hydraulic oil passages 45 in the first support mode (to be described below). That is, the first shaft holes 41 define portions of the first hydraulic oil passages 45 to which the hydraulic actuator 46 applies an oil pressure.

The first cylindrical bodies 44 are fitted into and held by the openings of the through holes 43.

As shown in FIG. 3, the first grooves 42 extend from the first shaft holes 41 in a direction opposite to the cam shafts 3 and 4. When viewed in the axial direction of the cam shafts 3 and 4, the shape of the first grooves 42 according to this preferred embodiment is preferably an arc around the valve stem distal end 5*c* or 6*c* of the intake valve 5 or the exhaust valve 6. A bottom surface 42*a* of the first groove 42 and one end surface 44*a* of the first cylindrical body 44 are positioned on the same plane. In this preferred embodiment, a relatively narrow extended portion 47 is provided at one end of the first groove 42, which is close to the cam shaft 3 or 4. The extended portion 47 avoids interference with a pin 48 (see FIG. 1) of each of the rocker arms 7 to 10 (to be described below).

The width of the first groove 42 is the same as or slightly larger than the outer diameter of the first cylindrical body 44. A groove wall 42*b* at one end of the first groove 42, at which the first shaft hole 41 is positioned, is defined by a circumferential surface having an arcuate section positioned on the same axis as that of the first shaft hole 41 when viewed in the axial direction of the cam shaft 3 or 4.

The first grooves 42 define and function as tracks 49 that determine the moving paths of the rocker arms 7 to 10 in the second support mode (to be described below). The tracks 49 extend from the first shaft holes 41 in a direction opposite to the cam shafts 3 and 4.

Mounting seats 50 that mount the support members 36 are provided between the first support walls 34 on the intake valve side and the first support walls 35 on the exhaust valve side in the journal member 15. The mounting seats 50 project in the axial direction of the cam shafts 3 and 4 from the wall surfaces of the first support walls 34 and 35.

A through hole 51 extending in the cylinder axial direction (the vertical direction in FIG. 3) and two screw holes 52 extending in the axial direction of the cam shafts 3 and 4 are provided in the mounting seat 50, which includes knock pins 53 on a surface thereof. A fixing bolt 54 (see FIG. 1) is inserted into the through hole 51. The fixing bolt 54 is screwed into the cylinder head 2 through the mounting seat 50. The journal member 15 according to this preferred embodiment is fixed to the cylinder head 2 by the fixing bolts 54 and the above-described first fixing bolts 31 that fix the cam caps.

The mounting bolts 37 extending through the support member 36 are screwed into the screw holes 52 of the mounting seat 50. The support member 36 is mounted on the mounting seat 50 by the mounting bolts 37. When the support member 36 is mounted on the mounting seat 50, spaces S (see FIG. 5) are provided between the support member 36 and the first support walls 34 and 35. Portions of the rocker arms 7 to 10 (to be described below) are inserted into the spaces S.

The knock pins 53 of the mounting seats 50 are used to position the support member 36 with respect to the journal member 15. The knock pins 53 fit into pin holes 55 (see FIG. 4) of the support member 36 when the support member 36 is mounted on the mounting seat 50.

As shown in FIG. 2, the support member 36 preferably has a square pillar shape extending in a direction in which the intake cam shaft 3 and the exhaust cam shaft 4 extend. Second support walls 56 and 57 facing the first support walls 34 and 35 on the journal member side are provided on one side of the support member 36, which faces the journal member 15. That is, on one side of the support member 36, which faces the journal member 15, the second support wall 56 on the intake valve side is provided in one end in the longitudinal direction, and the second support wall 57 on the exhaust valve side is provided in the other end. In this preferred embodiment, the second support walls 56 and 57 on the support member 36 correspond to "a second support wall."

The second support walls 56 and 57 and the first support walls 34 and 35 are separate members, and one is connected to be separable to the other by fastening members including the mounting bolts 37.

Also, through holes 58 into which the mounting bolts 37 are inserted and the above-described pin holes 55 are provided between the second support walls 56 and 57 of the support member 36.

Figure 4:
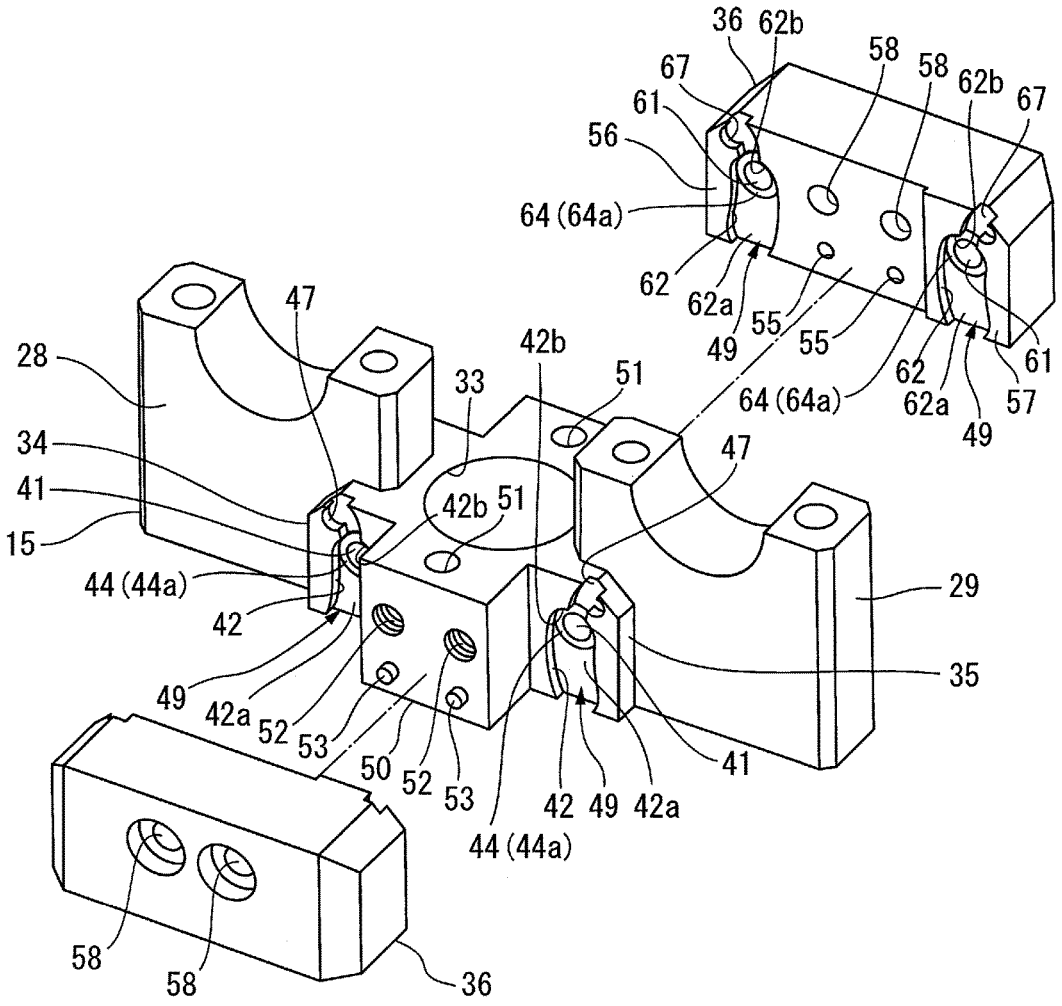
FIG. 4 is a perspective view of the journal member according to the first preferred embodiment of the present invention.
Figure 5:
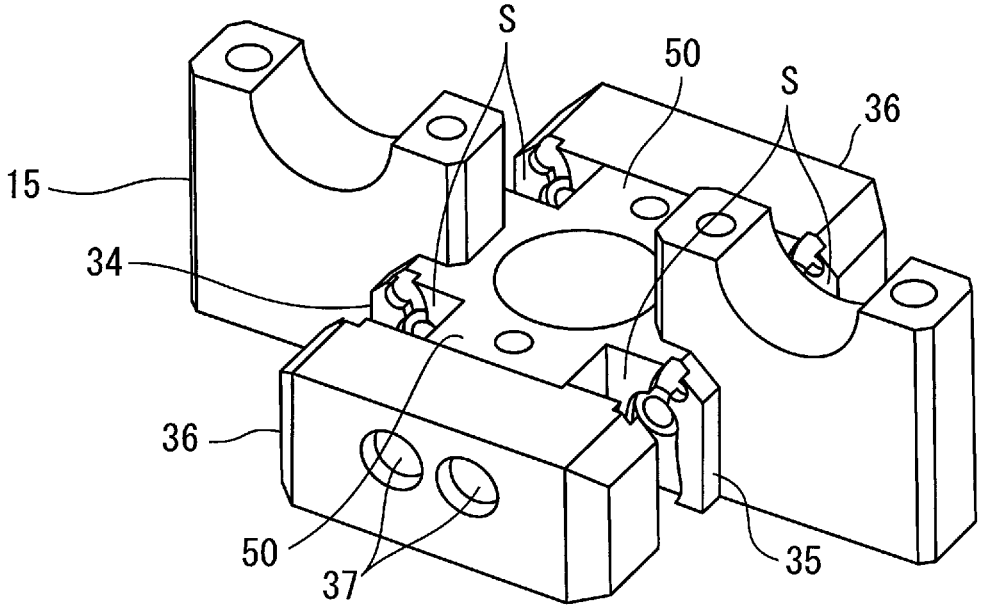
FIG. 5 is a perspective view showing the assembled state of the journal member and support members according to the first preferred embodiment of the present invention.

As shown in FIG. 4, second shaft holes 61 and second grooves 62 are provided in the second support walls 56 and 57.

As shown in FIG. 6, the second shaft hole 61 includes a non-through hole 63 in the support member 36, and a hollow portion of a second cylindrical body 64 in the opening of the non-through hole 63. Also, the second shaft hole 61 is positioned on the same axis as that of the first shaft hole 41 when the support member 36 is mounted on the journal member 15.

The non-through holes 63 extend in a direction parallel or substantially parallel to the axial direction of the cam shafts 3 and 4.

Second hydraulic oil passages 65 in the support member 36 and the cylinder head 2 are connected to the ends of the non-through holes 63 in the support member 36.

The second hydraulic oil passages 65 are connected to the hydraulic actuator 46 which applies an oil pressure to the second hydraulic oil passages 65 in the second support mode (to be described below). That is, the second shaft holes 61 define portions of the second hydraulic oil passages 65 to which the hydraulic actuator 46 applies the oil pressure.

When applying an oil pressure to the second hydraulic oil passages 65, the hydraulic actuator 46 changes the internal state of the above-described first hydraulic oil passages 45 to a state in which the hydraulic oil freely flows. On the other hand, when applying an oil pressure to the first hydraulic oil passages 45, the hydraulic actuator 46 changes the internal state of the second hydraulic oil passages 65 to a state in which the hydraulic oil freely flows.

The second cylindrical body 64 is fitted into and held by the opening of the non-through hole 63. The inner diameter of the second cylindrical body 64 (the hole diameter of the second shaft hole 61 which opens in the second support wall 56 or 57) is the same as the inner diameter of the above-described first cylindrical body 44 (the hole diameter of the first shaft hole 41 which opens in the first support wall 34 or 35).

A piston 66 is movably fitted into the second cylindrical body 64. The piston 66 receives the oil pressure applied to the second hydraulic oil passage 65. The piston 66 preferably has a closed-end cylindrical shape. The piston 66 is fitted into the second cylindrical body 64 such that the bottom portion is positioned on the opening side of the second shaft hole 61. A stopper 66*a* is provided on the opening-side end of the piston 66.

The stopper 66*a* determines a stop position when the piston 66 advances by the oil pressure in the second hydraulic oil passage 65. The stopper 66*a* according to this preferred embodiment preferably has a flange shape projecting outward in the radial direction of the piston 66. When an outer bottom surface 66*b* of the piston 66 is positioned on the same plane as that of one end (opening end) of the second cylindrical body 64, the stopper 66*a* abuts against the other end surface of the second cylindrical body 64. The position of the piston 66 when the stopper 66*a* regulates the advance of the piston 66 by the oil pressure will simply be called "a retreat position" hereinafter.

As shown in FIG. 4, the second grooves 62 of the second support walls 56 and 57 have the same arrangement as that of the first grooves 42 of the first support walls 34 and 35.

That is, the second grooves 62 extend from the second shaft holes 61 in a direction opposite to the cam shafts 3 and 4. When viewed in the axial direction of the cam shafts 3 and 4, the shape of the second groove 62 according to this preferred embodiment is preferably an arc around the valve stem distal end 5*c* or 6*c* of the intake valve 5 or the exhaust valve 6. A bottom surface 62*a* of the second groove 62 and an end surface 64*a* of the second cylindrical 64 are positioned on the same plane. Also, extended portions 67 that avoid interference with the pins 48 of the rocker arms 7 to 10 (to be described below) are provided in the second grooves 62.

The width of the second groove 62 is the same as or slightly larger than the outer diameter of the second cylindrical body 64. This groove width is the same as that of the first groove 42.

A groove wall 62*b* at one end of the second groove 62 where the second shaft hole 61 is positioned is defined by a circumferential surface having an arcuate section positioned on the same axis as that of the second shaft hole 61 when viewed in the axial direction of the cam shaft.

The second grooves 62 define and function as the tracks 49 that determine the moving paths of the rocker arms 7 to 10 in cooperation with the first grooves 42 in the second support mode (to be described below).

Figure 7:
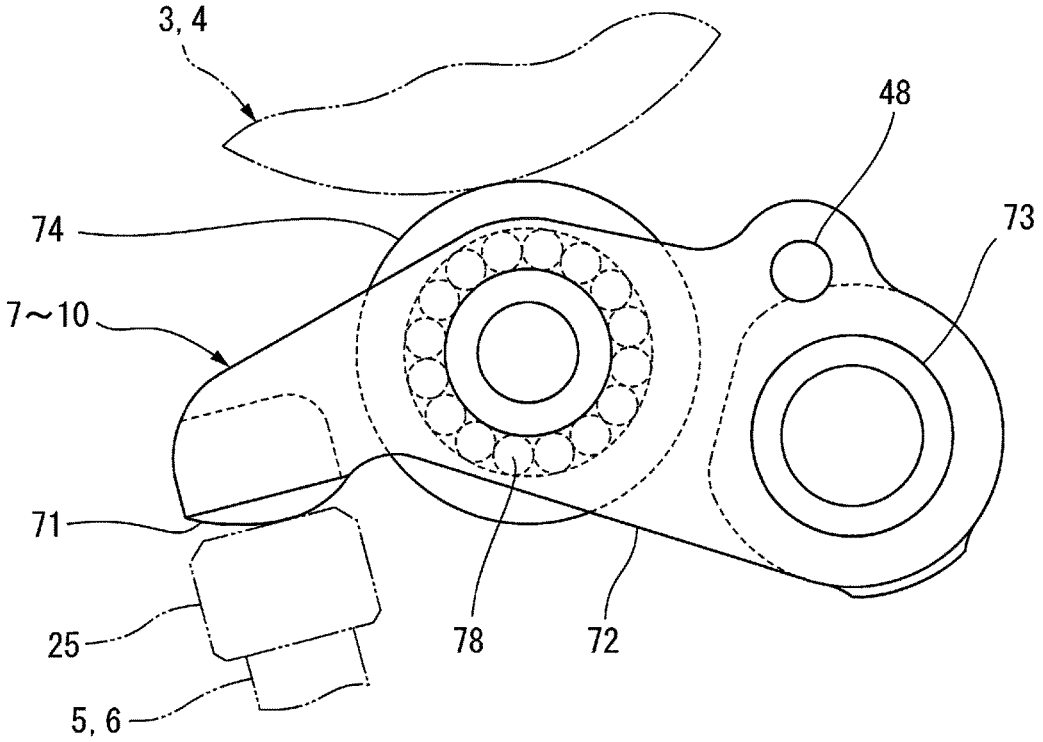
FIG. 7 is a side view of a rocker arm according to the first preferred embodiment of the present invention.

The intake valve rocker arms 7 and 8 in contact with the intake valve driving cam 17 and the exhaust valve rocker arms 9 and 10 in contact with the exhaust valve driving cam 19 have the same structure. As shown in FIG. 7, each of the rocker arms 7 to 10 includes a rocker arm main body 72 including one end on which a presser 71 which comes into contact with the shim 25 (a valve stem) of the intake valve 5 or exhaust valve 6 is provided, a cylindrical body 73 and the pin 48 on the other end of the rocker arm main body 72, and a roller 74 in a middle portion of the rocker arm main body 72.

Figure 8:
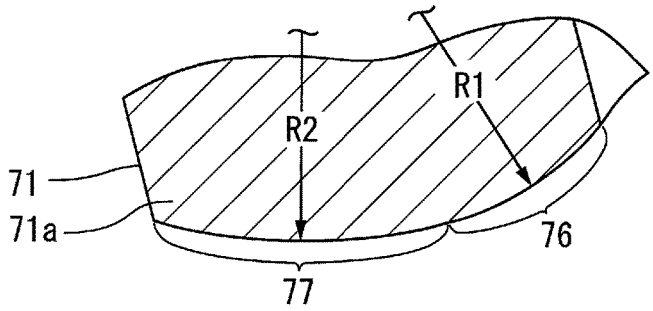
FIG. 8 is a side view showing a presser of the rocker arm in an enlarged scale according to the first preferred embodiment of the present invention.

As shown in FIG. 8, a contact portion 71*a* of the presser 71 of the rocker arms 7 to 10, which comes into contact with the shim 25 (a valve stem) of the intake valve 5 or the exhaust valve 6 preferably has an arcuate section projecting toward the intake valve 5 or the exhaust valve 6 when viewed in the axial direction of the cam shafts 3 and 4. The projecting end of the contact portion 71*a* preferably has a shape obtained by connecting a plurality of arcs 76 and 77 having different radii when viewed in the axial direction of the cam shafts 3 and 4. Of the plurality of arcs 76 and 77, a radius R1 of the first arc 76 positioned at the other-end side of the rocker arms 7 to 10 (on the right side in FIG. 8) is smaller than a radius R2 of the second arc 77 positioned on one-end side of the rocker arms 7 to 10.

Figure 9:
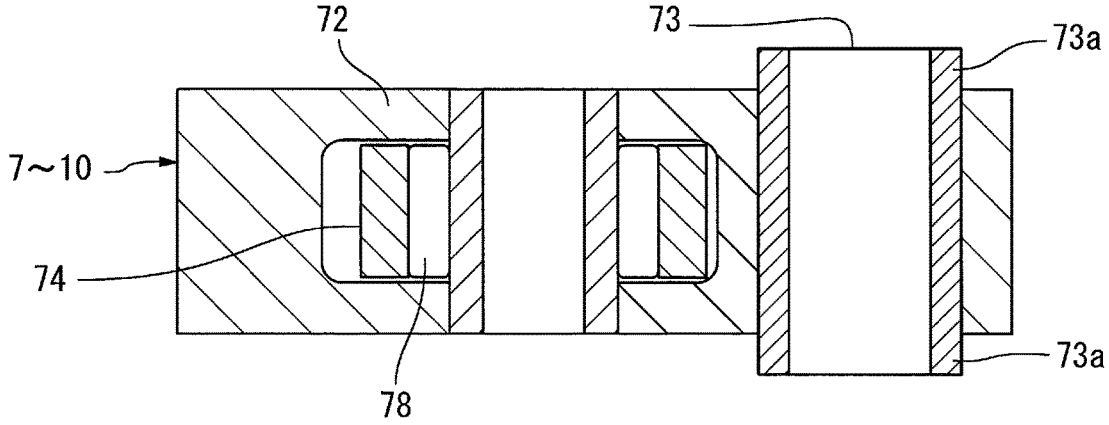
FIG. 9 is a sectional view of the rocker arm according to the first preferred embodiment of the present invention.

As shown in FIG. 9, the cylindrical body 73 of the rocker arm is defined by a cylinder, and is fixed to the rocker arm main body 72 so as to extend through the other end of the rocker arm main body 72 in a direction parallel or substantially parallel to the axial direction of the cam shafts 3 and 4 (the vertical direction in FIG. 9). The two ends of the cylindrical body 73 project by a predetermined length from the side surfaces of the rocker arm main body 72.

The outer diameter of the cylindrical body 73 has a dimension that fits into the first grooves 42 of the first support walls 34 and 35 and the second grooves 62 of the second support walls 56 and 57.

Figure 10:
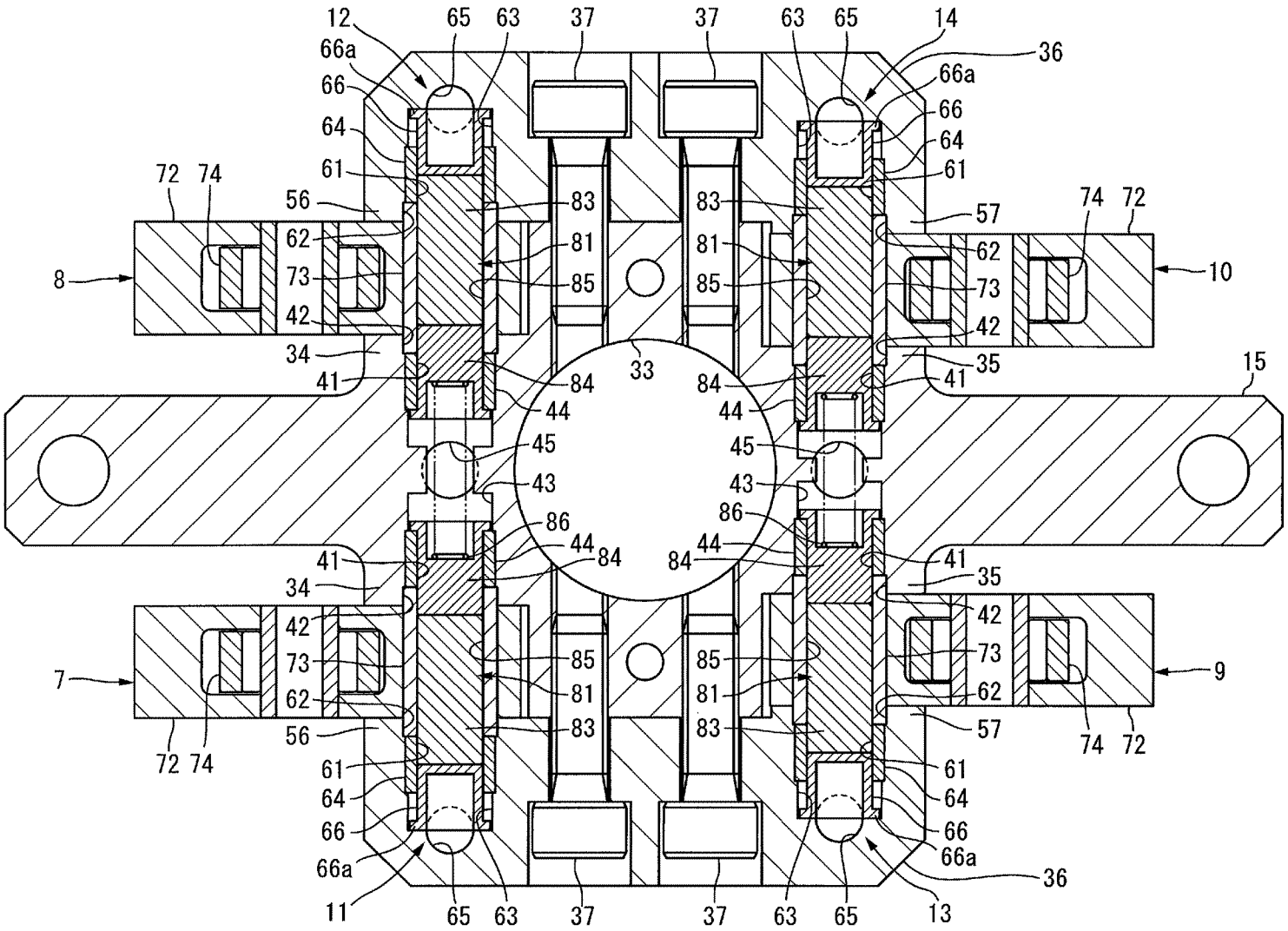
FIG. 10 is a sectional view of the valve gear according to the first preferred embodiment of the present invention taken along line X-X in FIG. 1.
Figure 11:
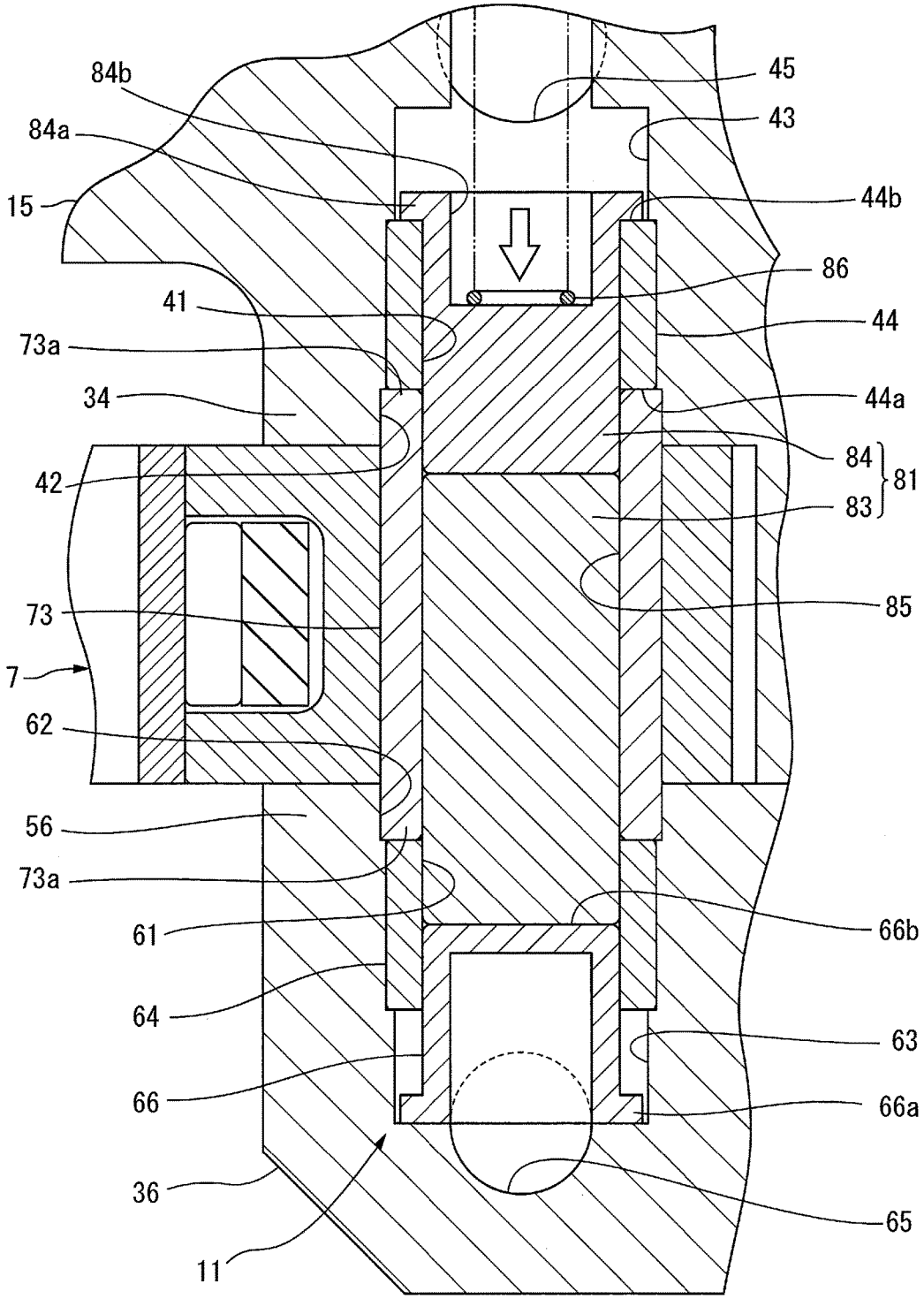
FIG. 11 is a sectional view showing main portions of the valve gear in an enlarged scale according to the first preferred embodiment of the present invention, and shows a first support mode.

Also, as shown in FIGS. 10 and 11, the total length of the cylindrical body 73 fits between the first groove 42 of the journal member 15 and the second groove 62 of the support member 36 mounted on the journal member 15. In this preferred embodiment, projecting portions 73*a* (see FIG. 11) of the cylindrical body 73, which project from the rocker arm main body 72, define "a projection."

The pin 48 of the rocker arms 7 to 10 is preferably a circular column, and, as shown in FIG. 7, is positioned between the cylindrical body 73 and the roller 74, and closer to the cam shaft side than the cylindrical body 73. The pin 48 also extends through the rocker arm main body 72 in the direction parallel or substantially parallel to the axial direction of the cam shafts 3 and 4. The cylindrical body 73 and the pin 48 have the same length. In this preferred embodiment, the pin 48 defines "a stopper."

The roller 74 is rotatably supported by the rocker arm main body 72 via a bearing 78. The axis of the roller 74 is parallel or substantially parallel to axes of the cam shafts 3 and 4.

As shown in FIG. 1, the rocker arms 7 to 10 are supported on the first support walls 34 and 35 and second support walls 56 and 57 by the supports 11 to 14 (to be described below) in a state in which the presser 71 (one end) is in contact with the intake valve 5 or the exhaust valve 6, and the cylindrical body 73 (the other end) is inserted into the space S described previously.

As shown in FIG. 10, of the four rocker arms 7 to 10 of the valve gear 1, the two intake valve rocker arms 7 and 8 are supported by the first support 11 and second support 12. The two exhaust valve rocker arms 9 and 10 are supported by the third support 13 and the fourth support 14. The first to fourth supports 11 to 14 have the same structure. Therefore, the first support 11 that supports the intake valve rocker arm 7 will be explained below. The same reference numerals as in the first support 11 denote the same elements in the second to fourth supports 12 to 14, and a detailed explanation thereof will be omitted.

As shown in FIG. 1, the first support 11 includes a rocker shaft 81 positioned in the cylindrical body 73 of the rocker arm 7, and a pressing mechanism 82 that biases the end of the rocker arm 7, which includes the cylindrical body 73, toward the cam 17 of the intake valve cam shaft 3.

As shown in FIG. 11, the rocker shaft 81 includes a first rocker shaft half 83 and a second rocker shaft half 84.

The first rocker shaft half 83 and the second rocker shaft half 84 extend in the axial direction of the cam shafts 3 and 4 (the vertical direction in FIG. 11). Also, the first rocker shaft half 83 and second rocker shaft half 84 are arranged along the axial direction and in contact with each other. The length of the first rocker shaft half 83 is equal to that of the cylindrical body 73 of the rocker arm. The second rocker shaft half 84 is shorter than the first rocker shaft half 83, and arranged along the axial direction such that the distal end is in contact with the first rocker shaft half 83. Also, the diameters of the first rocker shaft half 83 and second rocker shaft half 84 are the same.

The first rocker shaft half 83 shown in FIG. 11 is movably fitted into a third shaft hole 85 which is a hollow portion of the cylindrical body 73 of the rocker arm 7, and in the second shaft hole 61 (the second cylindrical body 64) of the second support wall 56. The third shaft hole 85 of each of the rocker arms 7 to 10 is positioned on the same axis as that of the cylindrical body 73, and extends through each of the rocker arms 7 to 10. The diameter of the third shaft hole 85 is the same as the diameters of the first and second shaft holes 41 and 61.

The second rocker shaft half 84 shown in FIG. 11 is movably fitted into the first shaft hole 41 (the first cylindrical body 44) in the first support wall 34, and in the third shaft hole 85 of the rocker arm 7.

As shown in FIG. 10, the second rocker shaft halves 84 according to this preferred embodiment are inserted into the two ends of the first shaft hole 41 extending through the journal member 15. That is, the second rocker shaft half 84 of the first support 11 and the second rocker shaft half 84 of the second support 12 are inserted into one first shaft hole 41. In addition, the second rocker shaft half 84 of the third support 13 and the rocker shaft half 84 of the fourth support 14 are inserted into one first shaft hole 41.

Furthermore, the second rocker shaft half 84 is movably fitted into the first cylindrical body 44 so as to receive the oil pressure applied to the first hydraulic oil passage 45. That is, the second rocker shaft half 84 defines a piston which moves in the first cylindrical body 44. As shown in FIG. 11, a stopper 84*a* and a recess 84*b* are provided in the end of the second rocker shaft half 84 which is opposite to the first rocker shaft half 83. The stopper 84*a* determines a stop position of the second rocker shaft half 84 when the second rocker shaft half 84 advances by the oil pressure in the first hydraulic oil passage 45.

The stopper 84*a* preferably has a flange shape projecting outward in the radial direction of the second rocker shaft half 84. Also, the stopper 84*a* abuts against the other end surface 44*b* of the first cylindrical body 44 in a state in which one end (the front end when advancing) of the second rocker shaft half 84 is fitted into the third shaft hole 85 of the rocker arm 7. The position of the second rocker shaft half 84 when the stopper 84*a* regulates the advance of the second rocker shaft half 84 will simply be called "an advance position" hereinafter.

One end of a compression coil spring 86 abuts against the bottom of the recess 84*b* of the second rocker shaft half 84. The compression coil spring 86 biases the second rocker shaft half 84 positioned in one end of the through hole 43 and the second rocker shaft half 84 positioned in the other end of the through hole 43 in directions away from each other. Therefore, if the oil pressure applied to the first hydraulic oil passage 45 including the through hole 43 is interrupted for some reason, the spring force of the compression coil spring 86 moves the second rocker shaft half 84 to the advance position.

As shown in FIG. 1, the pressing mechanism 82 includes a closed-end cylindrical pressing member 91 movably supported by the cylinder head 2, and a compression coil spring 92 inserted between the pressing member 91 and the cylinder head 2. The pressing member 91 preferably has a closed-end cylindrical shape, and is supported by the cylinder head 2 such that the bottom portion is in contact with the rocker arms 7 to 10. The compression coil spring 92 is accommodated in a compressed state in the pressing member 91. In this preferred embodiment, the compression coil spring 92 that pushes the pressing member 91 as described above corresponds to "a return spring that biases the rocker arm toward the cam."

The first support mode is used when the hydraulic actuator 46 applies the oil pressure to the first hydraulic oil passage 45 in the support 11.

When the oil pressure is applied to the first hydraulic oil passage 45 and the hydraulic oil in the second hydraulic oil passage 65 freely flows, the rocker shaft 81 moves to the position shown in FIG. 11. That is, the first and second support walls 34 and 56 and the rocker arm 7 are connected via the rocker shaft 81. More specifically, in the first support mode, the oil pressure is applied to the second rocker shaft half 84, so the second rocker shaft half 84 moves to the advance position and fits into the first shaft hole 41 and the third shaft hole 85 of the rocker arm 7. In addition, the first rocker shaft half 83 moves as it is pushed by the second rocker shaft half 84, and fits into the third shaft hole 85 of the rocker arm 7 and the second shaft hole 61.

Figure 14:
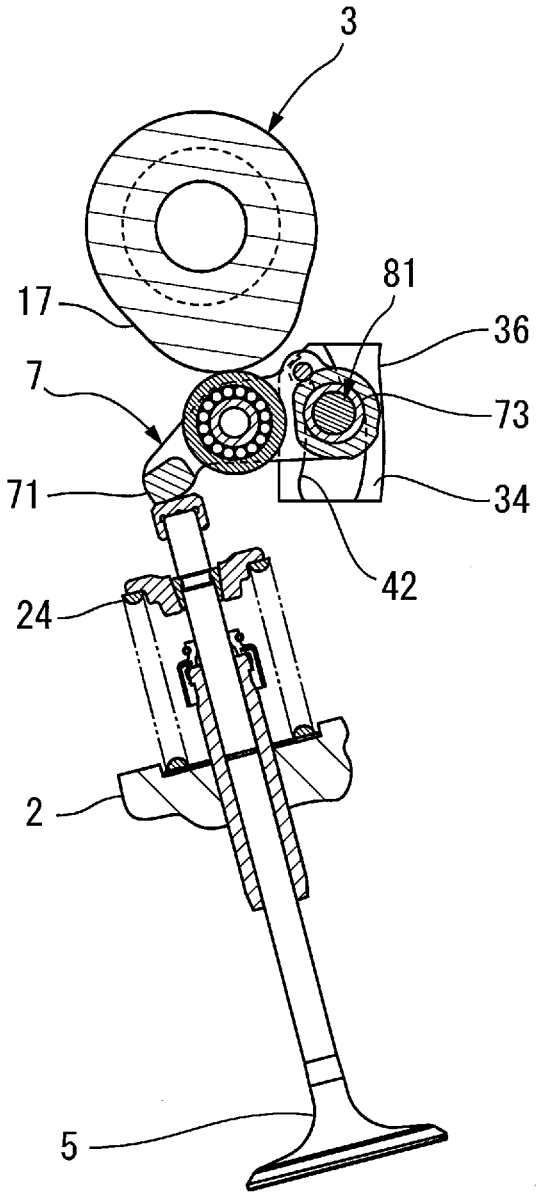
FIG. 14 is a sectional view of the valve gear according to the first preferred embodiment of the present invention, and shows the first support mode.

In the first support mode, as shown in FIG. 14, the rocker arm 7 swings around the rocker shaft 81, and the presser 71 presses the intake valve 5 against the spring force of the valve spring 24. In this state, the rocker arm 7 swings between the position of maximum lift shown in FIG. 14 and the initial position shown in FIG. 1.

In the first support mode, therefore, the rotations of the intake valve driving cam 17 and the exhaust valve driving cam 18 are converted into reciprocal motions by all the rocker arms 7 to 10 and transmitted to the intake valve 5 or the exhaust valve 6 to set the normal operation state.

Figure 12:
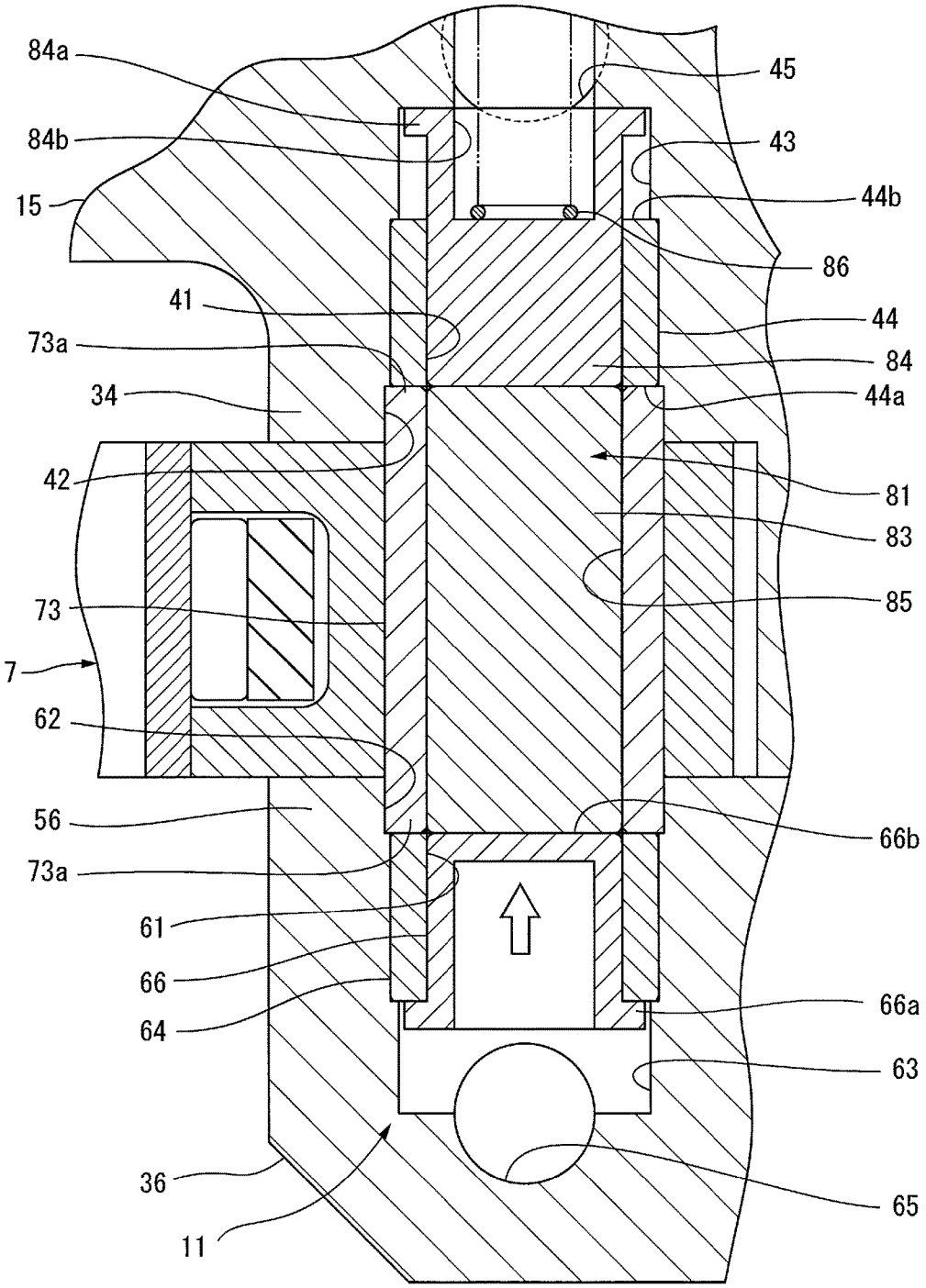
FIG. 12 is a sectional view showing the main portion of the valve gear in an enlarged scale according to the first preferred embodiment of the present invention, and shows a second support.

On the other hand, the mode shifts to the second support mode shown in FIG. 12 when the hydraulic actuator 46 applies oil pressure to the second hydraulic oil passage 65 and the hydraulic oil in the first hydraulic oil passage 45 freely flows. That is, the rocker shaft 81 moves to a position where the connection between the first and second support walls 34 and 56 and the rocker arm 7 is canceled. More specifically, in the second support mode, the oil pressure is applied to the piston 66, and the piston 66 moves to the retreat position. In this case, the first rocker shaft half 83 is pushed out from the second shaft hole 61 by the piston 66 and is accommodated in the cylindrical body 73 of the rocker arm 7. In addition, the second rocker shaft half 84 is pushed out from the cylindrical body 73 by the first rocker shaft half 83 and is accommodated in the first shaft hole 41.

Figure 15:
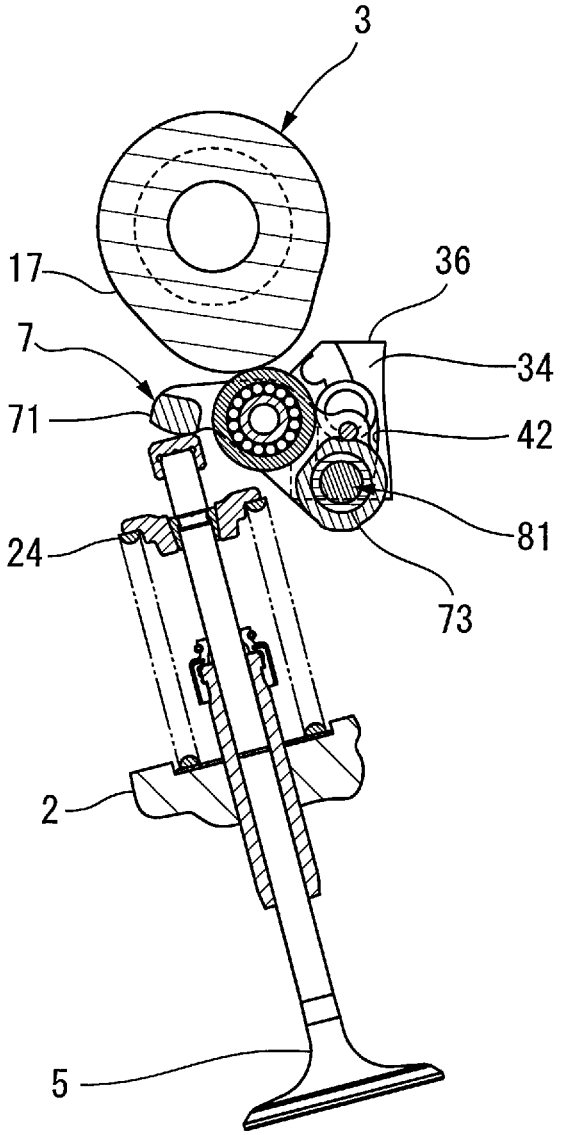
FIG. 15 is a sectional view of the valve gear according to the first preferred embodiment of the present invention, and shows the second support mode.

In the second support mode, as shown in FIG. 15, the rocker arm 7 is pushed by the cam 17 and swings around the presser 71 along the track 49 (the first and second grooves 42 and 62). This swinging motion of the rocker arm 7 is performed by the cylindrical body 73 which is fitted into the first groove 42 and the second groove 62 and slides along the first and second grooves 42 and 62.

In this state, the presser 71 rolls on the distal end surface of the shim 25 as the rocker arm 7 swings, because the contact portion 71*a* of the presser 71, which is in contact with the intake valve 5 or the exhaust valve 6, has an arcuate section.

After the apex 17*b* of the cam 17 passes the roller 74, the rocker arm 7 is pressed by the pressing mechanism 82, moves along the track 49, and returns to the initial position. In this state, the rocker arm 7 swings between the position of maximum lift shown in FIG. 15 and the initial position shown in FIG. 1.

Figure 13:
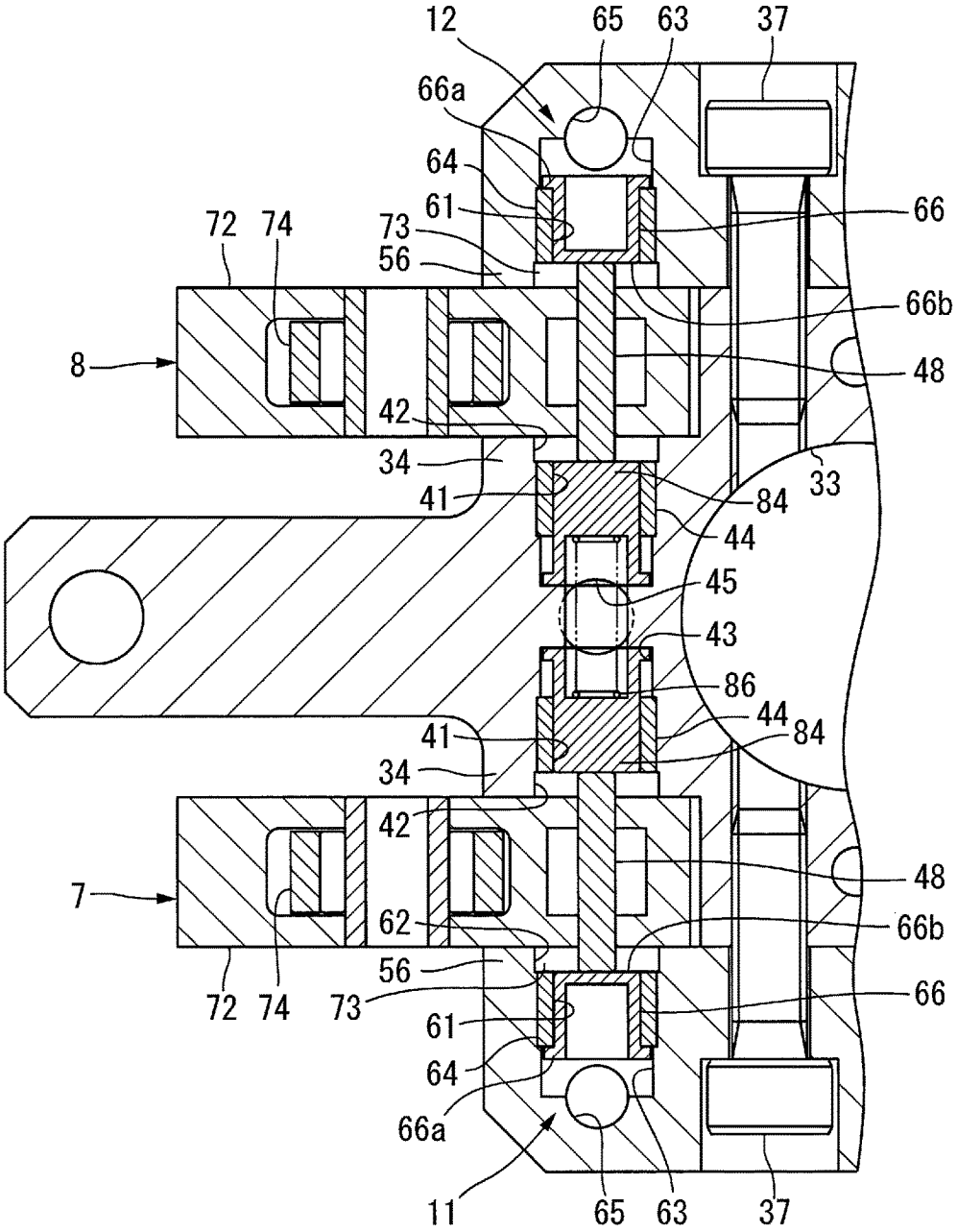
FIG. 13 is a sectional view showing pin portions of the rocker arms in an enlarged scale according to the first preferred embodiment of the present invention.

When the rocker arm 7 swings along the track 49, as shown in FIG. 13, one end of the pin 48 of the rocker arm 7 faces the second rocker shaft half 84, and the other end of the pin 48 faces the piston 66. In other words, the pin 48 is arranged in a position where the pin 48 faces the second rocker shaft half 84 and the piston 66 in the second support mode and the rocker arm 7 swings. By facing the second rocker shaft half 84 and the piston 66, the pin 48 inhibits these members from projecting into the moving region (space S) of the rocker arm 7 from the first support wall 34 and second support wall 56.

In the second support mode, therefore, no driving force is transmitted from all the rocker arms 7 to 10 to the intake valve 5 or the exhaust valve 6, so the intake valve 5 or the exhaust valve 6 is kept closed, thus setting the cylinder resting state.

When returning to the normal operation state from the cylinder resting state, the oil pressure need only be applied to the first hydraulic oil passage 45. This is because the moving path of the rocker arm 7 is regulated by the track 49. In the second support mode, the rocker arm 7 is positioned in the above-described initial position because the base circular portion 17*a* of the cam 17 comes into contact with the roller 74.

This initial position is a position where one end of the track 49 regulates the movement of the cylindrical body 73. When the rocker arm 7 is thus positioned in the initial position, the third shaft hole 85 of the rocker arm 7 and the first and second shaft holes 41 and 61 are positioned on the same axis. That is, when the rocker arm 7 is positioned in the initial position by applying the oil pressure to the first hydraulic oil passage 45, the second rocker shaft half 84 readily moves to the advance position by the oil pressure.

Consequently, the second support mode correctly shifts to the first support mode.

In the valve gear 1 for an engine according to this preferred embodiment, the normal operation state and the cylinder resting state are switched by moving the rocker shaft 81 in the axial direction. That is, the valve gear 1 for an engine according to this preferred embodiment uses a simple structure as the support structures 11 to 14 of the rocker arms 7 to 10. In the valve gear 1 for an engine, therefore, the reliability of the switching operation of switching the rocker arm support modes is higher than that of the conventional valve gear described in Japanese Patent Laid-Open No. 2008-151115.

The track 49 according to this preferred embodiment is defined by the first and second grooves 42 and 62 in the side surfaces of the first and second support walls 34, 35, 56, and 57, which face the rocker arms 7 to 10. The projecting portions 73*a* of the cylindrical bodies 73, which are shaped to be fitted into the first and second grooves 42 and 62, are provided on the side surfaces of the rocker arms 7 to 10 which face the first and second support walls 34, 35, 56, and 57, so as to project from these side surfaces.

In this preferred embodiment, the track 49 uses portions of the first and second support walls 34, 35, 56, and 57 without using any dedicated member. Accordingly, when implementing the second support mode in which the rocker arms 7 to 10 are supported to be swingable along the track 49, it is unnecessary to increase the number of elements so the manufacturing cost is decreased.

The first and second shaft holes 41 and 61 according to this preferred embodiment open in the bottom portions of the first and second grooves 42 and 62. The third shaft holes 85 of the rocker arms 7 to 10 are positioned on the same axes as the axes of the cylindrical bodies 73 (projections), and extend through the rocker arms 7 to 10. The diameter of the first and second shaft holes 41 and 61 is the same as that of the third shaft holes 85.

In this preferred embodiment, the cylindrical body 73 moves along the first and second grooves 42 and 62, and is positioned in a position where the cylindrical body 73 faces the first and second shaft holes 41 and 61. Therefore, the rocker shaft 81 fits into the first and second shaft holes 41 and 61 and the third shaft hole 85. This makes it possible to accurately and rapidly align the third shaft hole 85 with the first and second shaft holes 41 and 61 by using the fit between the cylindrical body 73 and the first and second grooves 42 and 62.

Accordingly, this preferred embodiment provides a valve gear that smoothly performs the operation of shifting the second support mode to the first support mode.

The first and second grooves 42 and 62 according to this preferred embodiment preferably have an arc shape around the valve stem distal end 5*c* or 6*c* of the intake valve 5 or the exhaust valve 6 when viewed in the axial direction of the cam shafts 3 and 4. In addition, the first and second grooves 42 and 62 preferably have a shape matching the swinging direction of the rocker arms 7 to 10 in the second support mode. In this preferred embodiment, therefore, the rocker arms 7 to 10 smoothly swing in the second support mode, and this reduces an output loss caused when the rocker arms 7 to 10 swing as the cam shafts 3 and 4 rotate in the cylinder resting state. Furthermore, abrasion of the sliding portions of the cylindrical bodies 73 of the rocker arms 7 to 10 and the first and second grooves 42 and 62 is reduced, so it is possible to maintain the initial performance for a long time period.

In the valve gear 1 for an engine according to this preferred embodiment, the first support mode is used by applying an oil pressure to the first hydraulic oil passages 45, and the second support mode is used by applying the oil pressure to the second hydraulic oil passages 65.

Accordingly, the rocker shafts 81 are forcedly moved by the oil pressure when switching between the first and second support modes. Therefore, this preferred embodiment provides a valve gear which increases the reliability of the operation of switching between the first and second support modes.

The rocker arms 7 to 10 according to this preferred embodiment include the pins 48 (stoppers) which face the second rocker shaft halves 84 and pistons 66 in a state in which the second support mode is used and the rocker arms 7 to 10 swing.

In this preferred embodiment, therefore, the second rocker shaft halves 84 and pistons 66 do not interfere with the swinging motions of the rocker arms 7 to 10 in the second support mode. Accordingly, the rocker arms 7 to 10 always correctly swing in the cylinder resting state, so a valve gear for an engine which further increases the operation reliability is provided.

The first support walls 34 and 35 and the second support walls 56 and 57 according to this preferred embodiment are preferably separate members, and one is detachably connected to the other by using the mounting bolts 37 (fastening members).

In this preferred embodiment, therefore, the first and second grooves 42 and 62 may be made by machining the first support walls 34 and 35 and the second support walls 56 and 57. Accordingly, it is possible to provide a valve gear for an engine which is easily manufactured although the valve gear includes the track 49 defined by the grooves in order to regulate the swinging motions of the rocker arms 7 to 10.

The first support walls 34 and 35 according to this preferred embodiment are integrated with the cam shaft journal member 15 of the cylinder head 2.

Accordingly, this preferred embodiment need not include any mounting portions to mount the first support walls 34 and 35 on the cam shaft journal member 15, and hence reduces the size and cost thereof.

The contact portion 71*a* of the rocker arms 7 to 10 according to this preferred embodiment, which comes into contact with the valve stem of the intake valve 5 or the exhaust valve 6 is provided on one end of the rocker arms 7 to 10 so as to have an arcuate section when viewed in the axial direction of the cam shafts 3 and 4. The shape of the projecting end of the contact portion 71*a* is a shape obtained by connecting the first arc 76 and the second arc 77. The radius R1 of the first arc 76 positioned in the other end of the rocker arms 7 to 10 is smaller than the radius R2 of the second arc 77 positioned in one end of the rocker arms 7 to 10.

The contact portion 71*a* of the rocker arms 7 to 10 according to this preferred embodiment preferably has an arcuate section, and hence rolls on the shim 25 (a valve stem) as the rocker arms 7 to 10 swing in the second support mode. Of the plurality of arcs defining the projecting end of the contact portion 71*a*, the first arc 76 having a small radius comes into contact with the shim 25 when the swinging angle of the rocker arms 7 to 10 increases. When the swinging angle of the rocker arms 7 to 10 increases, the cylindrical bodies 73 of the rocker arms 7 to 10 swing in the direction away from the cam shafts 3 and 4.

That is, the presser 71 of the rocker arms 7 to 10 rolls along the distal end surface of the shim 25 without falling off from the distal end surface, until the swinging angle of the rocker arms 7 to 10 becomes the maximum.

Accordingly, this preferred embodiment provides a valve gear for an engine capable of switching between the normal operation state and cylinder resting state by using the cam shafts 3 and 4 having a large valve lift amount.

Second Preferred Embodiment

The support may have a structure as shown in FIGS. 16 to 19. The same reference numerals as in FIGS. 1 to 15 denote the same or similar elements in FIGS. 16 to 19, and a detailed explanation thereof will be omitted.

Only a portion of a valve gear 101 for an engine according to the second preferred embodiment differs from the valve gear 1 for an engine explained with reference to FIGS. 1 to 15. The different portion includes the arrangements of rocker arms 102 to 105, the first and second grooves 106 and 107, the rocker shafts 108, and a hydraulic system to drive the rocker shafts 108.

Figure 16:
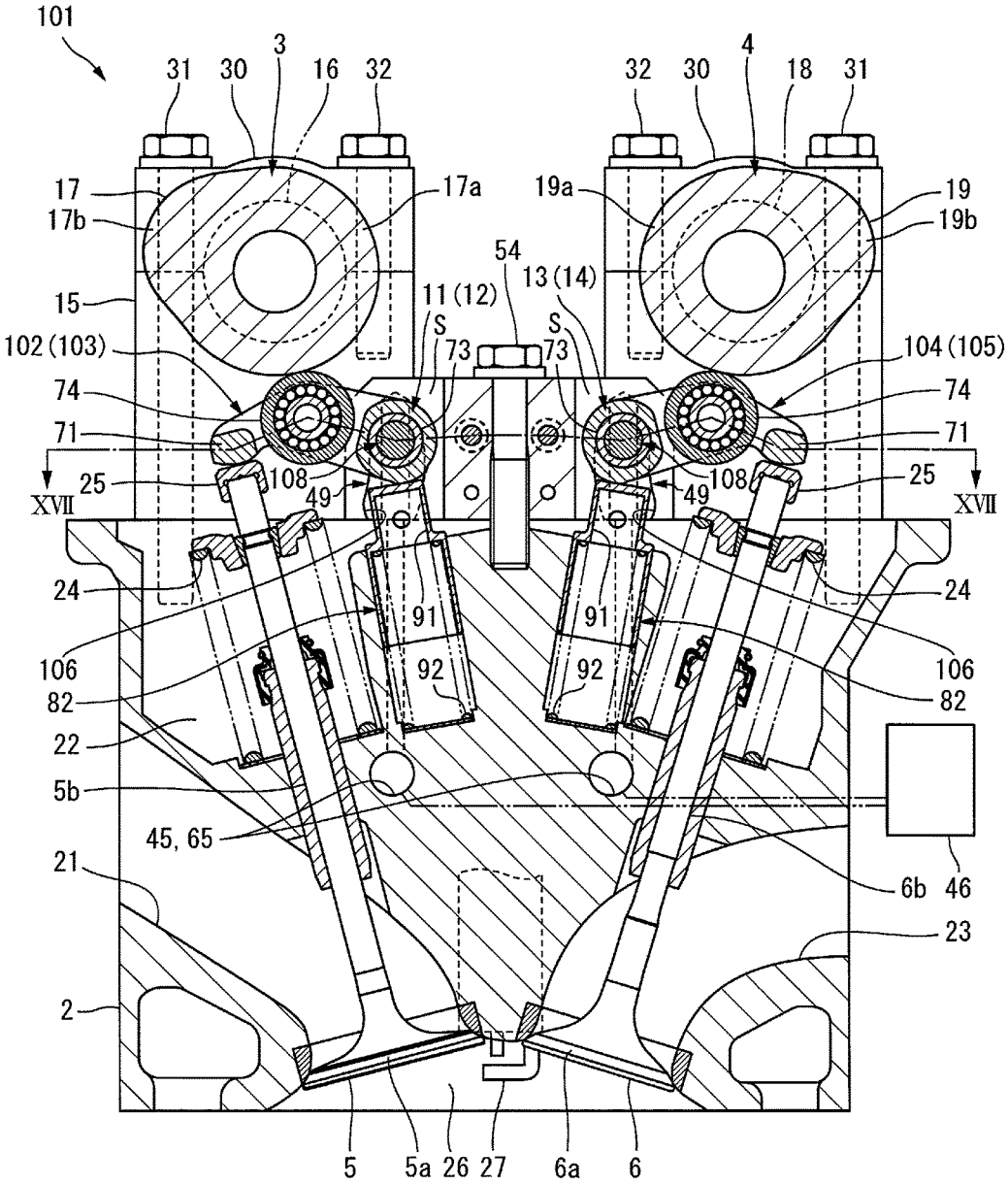
FIG. 16 is a sectional view of a valve gear according to a second preferred embodiment of the present invention.

As shown in FIG. 16, the rocker arms 102 to 105 according to this preferred embodiment do not include the pins 48 used in the first preferred embodiment. This is so because, as will be described in detail below, the rocker shafts 108 do not project into the moving regions (spaces S) of the rocker arms 102 to 105 in the second support mode.

In addition, the first and second grooves 106 and 107 according to this preferred embodiment do not have the extended portions 47 and 67 as in the first preferred embodiment.

Figure 17:
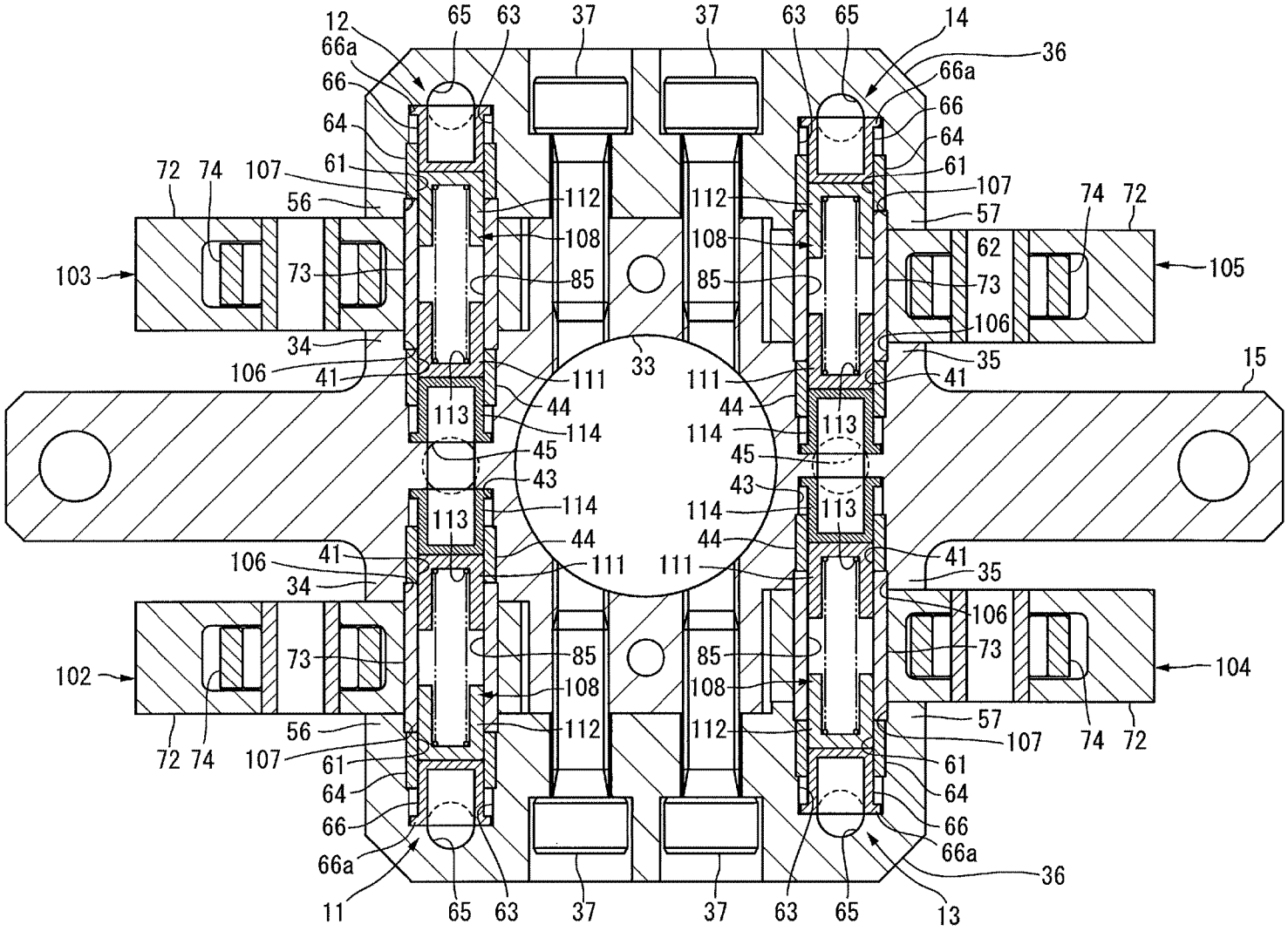
FIG. 17 is a sectional view of the valve gear according to the second preferred embodiment of the present invention taken along line XVII-XVII in FIG. 16.
Figure 18:
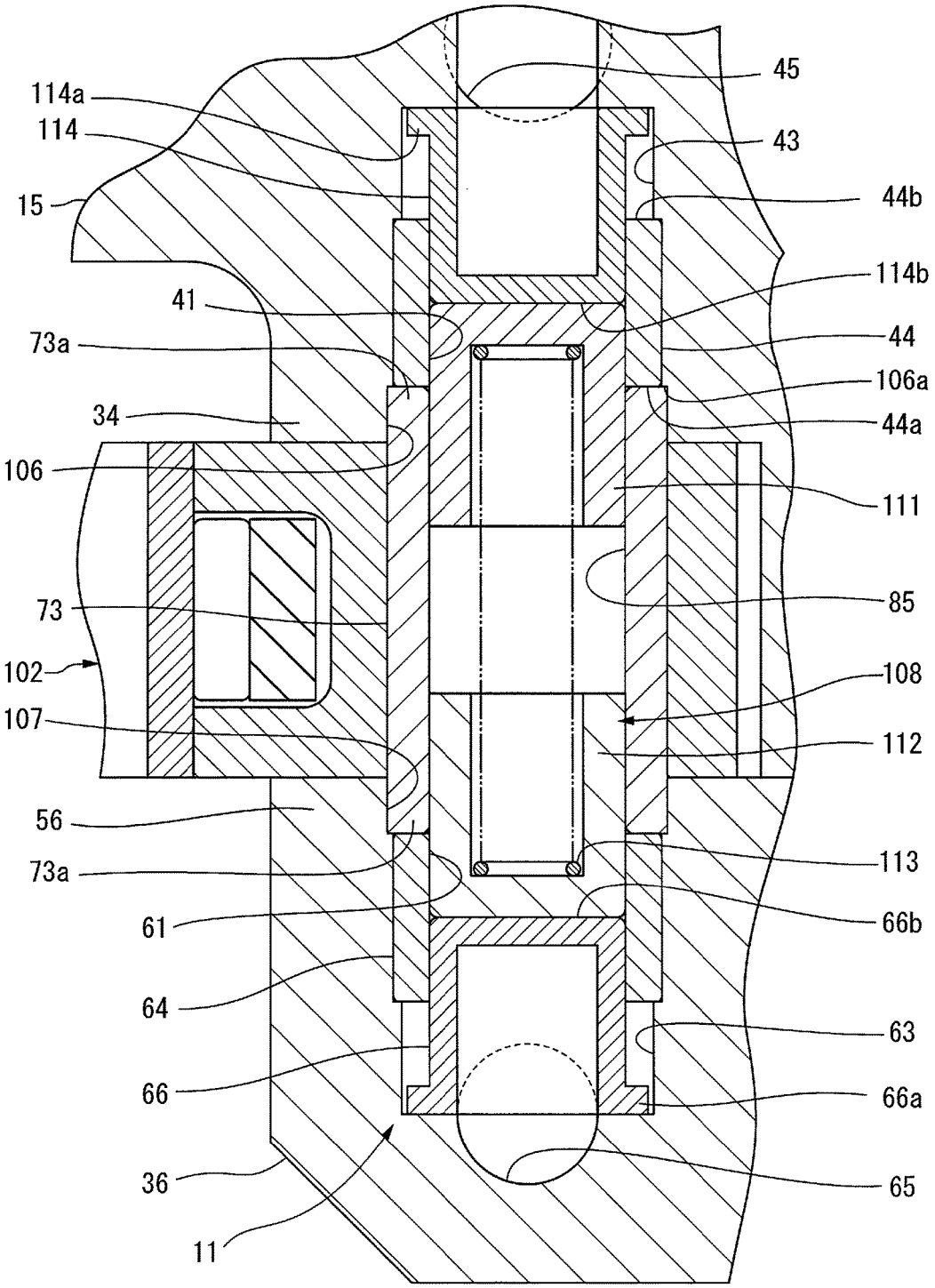
FIG. 18 is a sectional view showing main portions of the valve gear in an enlarged scale according to the second preferred embodiment of the present invention, and shows the first support mode.

As shown in FIGS. 17 and 18, the rocker shaft 108 according to this preferred embodiment includes a closed-end cylindrical first rocker shaft half 111 and a closed-end cylindrical second rocker shaft half 112 arranged in the axial direction. The rocker shaft halves 111 and 112 have the same outer diameter. Also, the lengths of the first rocker shaft half 111 and the second rocker shaft half 112 are set such that the total length of the rocker shaft 108, including the rocker shaft halves 111 and 112 when brought into contact with each other, matches the length of a third shaft hole 85 of the rocker arms 102 to 105.

The first rocker shaft half 111 and the second rocker shaft half 112 are movably fitted, with their openings facing each other, into first and second shaft holes 41 and 61 and the third shaft hole 85. The first rocker shaft half 111 shown in FIG. 18 is movably fitted into the first shaft hole 41 and the third shaft hole 85. The second rocker shaft half 112 shown in FIG. 18 is movably fitted into the third shaft hole 85 and second shaft hole 61.

Also, a compression coil spring 113 is accommodated in the first rocker shaft half 111 and the second rocker shaft half 112. The compression coil spring 113 biases the rocker shaft halves 111 and 112 in directions away from each other. In this preferred embodiment, the compression coil spring 113 corresponds to "a spring member."

A closed-end cylindrical piston 114 is movably fitted into the first shaft hole 41 (a first cylindrical body 44) according to this preferred embodiment. The piston 114 is used to receive the oil pressure applied to a first hydraulic oil passage 45. The piston 114 is movably fitted into the first cylindrical body 44 such that the bottom portion is in contact with the first rocker shaft half 111. A flange-shaped stopper 114*a* projecting outside in the radial direction is provided on the opening-side end of the piston 114.

Figure 19:
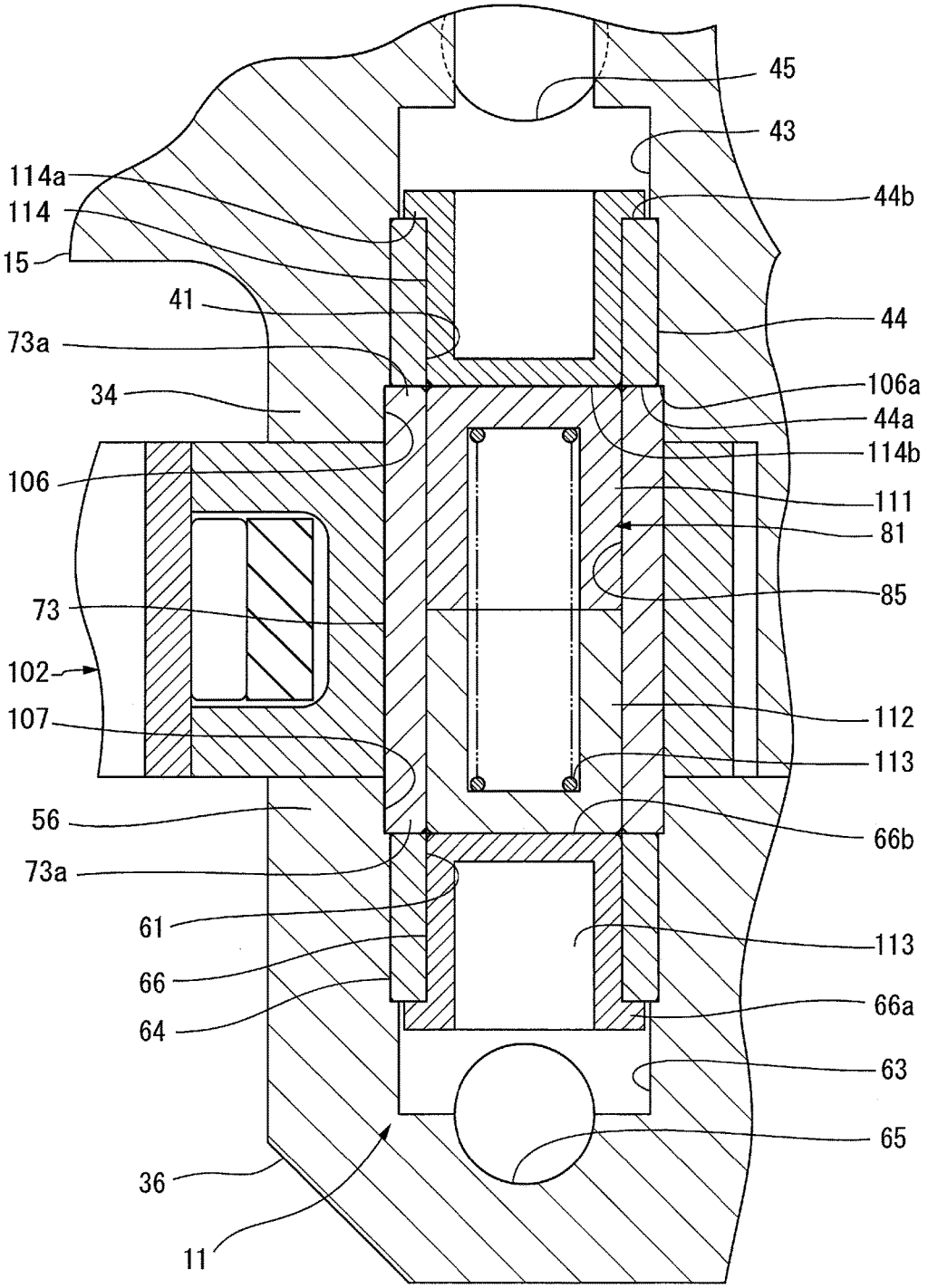
FIG. 19 is a sectional view showing the main portions of the valve gear in an enlarged scale according to the second preferred embodiment of the present invention, and shows the second support mode.

The stopper 114*a* regulates the movement of the piston 114*a* by abutting against an end surface 44*b* of the first cylindrical body 44. As shown in FIG. 19, a bottom surface 114*b* of the piston 114 (a surface which comes into contact with the first rocker shaft half 111) is positioned on the same plane as that of a bottom surface 106*a* of the first groove 106 in a state in which the stopper 114*a* abuts against the first cylindrical body 44. In this preferred embodiment, the piston 114 inserted into the first shaft hole 41 and a piston 66 inserted into the second shaft hole 61 correspond to "a piston."

A hydraulic actuator 46 according to this preferred embodiment sets a state in which hydraulic oil freely flows through both the first hydraulic oil passage 45 and a second hydraulic oil passage 65 in the first support mode. Also, the hydraulic actuator 46 applies the oil pressure to both the first hydraulic oil passage 45 and the second hydraulic oil passage 65 in the second support mode.

In the valve gear 101 for an engine disclosed in this preferred embodiment, when the first support mode is used and the oil pressure is reduced in the first hydraulic oil passage 45 and second hydraulic oil passage 65, the spring force of the compression coil spring 113 pushes the first rocker shaft half 111 and the second rocker shaft half 112. Then, as shown in FIG. 18, the first rocker shaft half 111 fits into the first shaft hole 41 and the third shaft hole 85. On the other hand, the second rocker shaft half 112 fits into the second shaft hole 61 and the third shaft hole 85. When the first support mode is used, therefore, the rocker arms 102 to 105 swing around the first and second rocker shaft halves 111 and 112 to set a normal operation state.

On the other hand, when the second support mode is used, the oil pressure is applied to the first hydraulic oil passage 45 and the second hydraulic oil passage 65. In this case, the piston 114 in the first shaft hole 41 pushes the first rocker shaft half 111 toward the rocker arms 102 to 105, and the piston 66 in the second shaft hole 61 pushes the second rocker shaft half 112 toward the rocker arms 102 to 105. As shown in FIG. 19, the first rocker shaft half 111 and the second rocker shaft half 112 are accommodated in the third shaft hole 85. When the second support mode is used, the rocker arms 102 to 105 swing along the first and second grooves 42 and 62 to set a cylinder resting state.

In this preferred embodiment, therefore, the first support mode and the second support mode are switched by only switching the state in which the oil pressure is applied to both the first hydraulic oil passage 45 and the second hydraulic oil passage 65, and the state in which oil pressure is reduced in the two hydraulic oil passages 45 and 65. In this preferred embodiment, the hydraulic circuit is simplified compared to a case in which the application and the stopping of the oil pressure are individually switched in the two hydraulic oil passages 45 and 65. Accordingly, this preferred embodiment provides a valve gear for an engine that reduces the manufacturing cost of the hydraulic actuator 46 and the hydraulic circuit.

Figure 20:
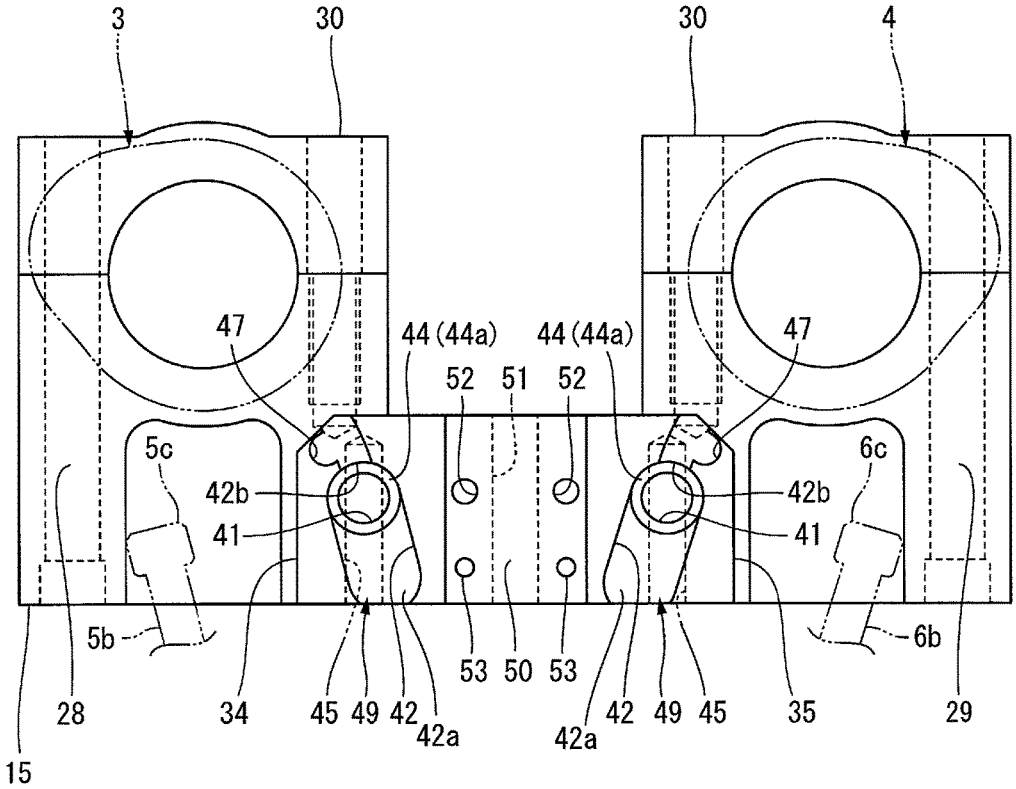
FIG. 20 is a side view of a journal member showing a track according to another preferred embodiment of the present invention.

In the first preferred embodiment and the second preferred embodiment described above, the first groove 42 and second groove 62 preferably have an arcuate shape. However, the present invention is not limited to this. As shown in FIG. 20, the first groove 42 and second groove 62 may have a linear shape extending along the valve stem of the intake valve 5 or the exhaust valve 6.

Even in this preferred embodiment, the same effects as those of the above-described preferred embodiments are obtained.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A valve gear for an engine comprising:

a cam shaft including one of an intake valve driving cam and an exhaust valve driving cam, the cam shaft being rotatably supported by a cylinder head;

a pair of support walls in the cylinder head spaced apart and facing each other in an axial direction of the cam shaft;

a rocker arm including a first end in contact with a valve shaft of one of an intake valve and an exhaust valve and a second end inserted between the pair of support walls; and a support supporting the rocker arm on the pair of support walls and that switches among a plurality of support modes, the support including:

shaft holes in the pair of support walls and the second end of the rocker arm and each extending parallel or substantially parallel to the cam shaft;

a rocker shaft that is movably fitted into the shaft holes;

tracks in the pair of support walls and each extending from a corresponding one of the shaft holes in a direction opposite to the cam shaft; and a return spring that biases the rocker arm toward the cam;

the plurality of support modes include:

a first support mode in which the rocker arm swings around the rocker shaft as a center to convert a rotation of the cam into a reciprocal motion and to transmit the reciprocal motion to one of the intake valve and the exhaust valve; and a second support mode in which the rocker arm swings along the track around a portion in contact with the valve shaft of one of the intake valve and the exhaust valve, as a center, to keep the one of the intake valve and the exhaust valve closed; and the rocker shaft moves to a position where the pair of support walls and the rocker arm are connected via the rocker shaft in the first support mode, and the rocker shaft moves to a position where a connection between the pair of support walls and the rocker arm is canceled in the second support mode.

2. The valve gear for an engine according to claim 1, wherein the tracks each include a groove in a side surface of the pair of support walls that face the rocker arm; and projections are provided in side surfaces of the rocker arm, each of the projections facing the pair of support walls and having a shape that fits into the groove and projects from the side surface.

3. The valve gear for an engine according to claim 2, wherein the shaft holes of the pair of support walls each open in a bottom of the groove;

the shaft hole of the rocker arm is positioned on a same axis as that of the projection, and extends through the rocker arm; and diameters of the shaft holes of the pair of support walls and a diameter of the shaft hole of the rocker arm are the same.

4. The valve gear for an engine according to claim 2, wherein, when viewed in the axial direction of the cam shaft, the groove has an arcuate shape or a substantially arcuate shape around a distal end of the valve shaft of one of the intake valve and the exhaust valve, or a linear shape or a substantially linear shape extending along the valve shaft of one of the intake valve and the exhaust valve.

5. The valve gear for an engine according to claim 1, wherein the shaft holes in the pair of support walls define a portion of a hydraulic oil passage to which an oil pressure is applied by a hydraulic actuator;

the rocker shaft includes a first rocker shaft half having a length equal to a length of the shaft hole of the rocker arm; and a second rocker shaft half inserted into the shaft hole of one of the pair of support walls to receive the oil pressure in the hydraulic oil passage, and that extends in an axial direction such that a distal end of the second rocker shaft half is in contact with the first rocker shaft half;

a piston that receives the oil pressure of the hydraulic oil passage and is fitted into the shaft hole of the other one of the pair of support walls;

in the first support mode, with the oil pressure applied to the second rocker shaft half, the second rocker shaft half fits into the shaft hole of the one of the pair of support walls and the shaft hole of the rocker arm, and the first rocker shaft half fits into both the shaft hole of the rocker arm and the shaft hole of the other one of the pair of support walls; and in the second support mode, with the oil pressure applied to the piston, the first rocker shaft half is accommodated in the rocker arm, and the second rocker shaft half is accommodated in the one of the pair of support walls.

6. The valve gear for an engine according to claim 5, wherein the rocker arm includes a stopper that faces the second rocker shaft half and the piston, and inhibits the second rocker shaft half and the piston from projecting from the pair of support walls into a moving region of the rocker arm in the second support mode when the rocker arm is swinging.

7. The valve gear for an engine according to claim 1, wherein the shaft holes in the pair of support walls define a portion of a hydraulic oil passage to which an oil pressure is applied by a hydraulic actuator;

the rocker shaft includes a first rocker shaft half and a second rocker shaft half that extend in an axial direction;

a length of the first rocker shaft half and a length of the second rocker shaft half are such that, when a total length of the rocker shaft including the first rocker shaft half and the second rocker shaft half is brought into contact with each other matches a length of the shaft hole of the rocker arm;

a spring member that biases the first rocker shaft half and the second rocker shaft half in directions away from each other is accommodated in the first rocker shaft half and the second rocker shaft half;

pistons that receive the oil pressure of the hydraulic oil passage including the shaft holes of the pair of support walls are fitted into the shaft holes;

in the first support mode, the first rocker shaft half and the second rocker shaft half are pushed by a spring force of the spring member and each is fitted into both the shaft hole of the rocker arm and the shaft hole of a corresponding one of the pair of support walls; and in the second support mode, with the oil pressure applied to the pistons, and the first rocker shaft half and the second rocker shaft half are accommodated in the rocker arm.

8. The valve gear for an engine according to claim 1, wherein a first support wall and a second support wall of the pair of support walls are separate members, and the first support wall is connected to the second support wall by a fastening member so as to be separable from each other.

9. The valve gear for an engine according to claim 8, wherein the first support wall of the pair of support walls is integral with a cam shaft journal member of the cylinder head.

10. The valve gear for an engine according to claim 1, wherein a contact portion of the rocker arm, which comes into contact with the valve shaft of one of the intake valve and the exhaust valve, is provided at a first end of the rocker arm, and has an arcuate section projecting toward the one of the intake valve and the exhaust valve when viewed in the axial direction of the cam shaft;

a shape of a projecting end of the contact portion is defined by connecting a plurality of arcs having different radii when viewed in the axial direction of the cam shaft; and a radius of one of the plurality of arcs, which is positioned closer to the second end of the rocker arm, is smaller than a radius of an arc positioned closer to the first end of the rocker arm.

* * * * *